US007507108B2

(12) United States Patent
Tsuji

(10) Patent No.: US 7,507,108 B2
(45) Date of Patent: Mar. 24, 2009

(54) CONNECTOR WITH A WIRE COVER FOR ALTERING A PULL-OUT DIRECTION OF WIRES

(75) Inventor: Takeshi Tsuji, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/891,691

(22) Filed: Aug. 13, 2007

(65) Prior Publication Data

US 2008/0188120 A1 Aug. 7, 2008

(30) Foreign Application Priority Data

Aug. 22, 2006 (JP) ..... 2006-225193

(51) Int. Cl.
*H01R 13/56* (2006.01)

(52) U.S. Cl. ..... 439/446; 439/470

(58) Field of Classification Search ..... 439/446, 439/470, 465, 8, 14, 731, 711
See application file for complete search history.

(56) References Cited

U.S. PATENT DOCUMENTS 4,959,021 A * 9/1990 Byrne ..... 439/310
5,839,911 A * 11/1998 Dinkel ..... 439/470
5,908,327 A 6/1999 Tsuji et al.
5,967,830 A * 10/1999 Tsuji ..... 439/470
6,019,638 A * 2/2000 Saka et al. ..... 439/620.15
6,059,602 A * 5/2000 Ward ..... 439/465
6,196,864 B1 * 3/2001 Huguenet ..... 439/446
6,406,314 B1 * 6/2002 Byrne ..... 439/215
6,773,296 B2 * 8/2004 Kihira et al. ..... 439/445
6,840,795 B1 * 1/2005 Takeda et al. ..... 439/492
7,131,858 B1 * 11/2006 Zerebilov ..... 439/446
7,186,133 B1 * 3/2007 Szczesny ..... 439/446
7,234,963 B1 * 6/2007 Huang et al. ..... 439/446

* cited by examiner

*Primary Examiner*—T C Patel
*Assistant Examiner*—Harshad C Patel
(74) *Attorney, Agent, or Firm*—Gerald E. Hespos; Anthony J. Casella

(57) ABSTRACT

A connector has a housing (10) accommodating terminal fittings connected with wires (W). A fixed cover (21) is mounted on the housing (10) and surrounds the wires (W) pulled out of the housing (10) and a movable cover (22) is mounted on an end of the fixed cover (21) opposite the end that is mounted on the housing (10). The fixed cover (21) has a receiving part (24) with a spherical peripheral surface (36). The movable cover (22) has a rotation-holding part (38) fit on an outer side of the receiving part (24). The rotation-holding part (38) is rotatable relative to the receiving part (24) about an axis of the housing (10) and about a rotational axis orthogonal to the axis of the housing (10).

8 Claims, 29 Drawing Sheets

CONNECTOR WITH A WIRE COVER FOR ALTERING A PULL-OUT DIRECTION OF WIRES

BACKGROUND OF THE INVENTION

1. Field of the Invention

The invention relates to a connector.

2. Description of the Related Art

U.S. Pat. No. 5,908,327 discloses a connector for a wire harness of a car. The connector has a housing that accommodates terminal fittings connected respectively with wires of the wiring harness. A cover is mounted at a rear portion of the housing and surrounds the electric wires pulled out of a rear surface of the housing.

The conventional connector has a specified pull-out direction for the electric wires. However, the pull-out direction of the wires may have to be changed in accordance with the mounting place and the mounting posture of the housing. Hence, a cover suitable for each pull-out direction of the electric wires is required. Each unique cover requires a dedicated mold, and it is necessary to prepare a large number of molding dies for producing the cover. The large number of molds creates inventory management problems and increases manufacturing costs.

The invention has been completed in view of the above-described situation, and it is an object of the invention to diversify the pull-out direction of an electric wire without increasing the kinds of a cover.

SUMMARY OF THE INVENTION

The invention relates to connector having a housing that accommodates terminal fittings connected with electric wires. A cover is mounted on the housing and surrounds the wires pulled out of the housing. A spherical receiving part is provided on one of the housing and the cover and a rotation-holding part provided on other of the housing and the cover. A peripheral surface of the spherical receiving part includes a spherical surface. The rotation-holding part is fit on the outer side of the spherical receiving part so that the rotation-holding part is rotatable relative to the spherical receiving part about an axis of the housing. The rotation-holding part has a cut-out that permits the rotation-holding part to rotate relative to the spherical receiving part about a rotational axis orthogonal to the axis of the housing. As a result, the cover can rotate relative to the housing to alter the pull-out direction of the electric wires three-dimensionally. Therefore, the kinds of molding dies needed for manufacturing the connector is decreased and inventory management is facilitated, as compared with the case where a cover is produced specifically in dependence on pull-out directions of the electric wires. Accordingly, the connector can be produced at a low cost.

The housing preferably has the spherical receiving part, and the cover preferably has the rotation-holding part. Therefore, the rotation-holding part is rotated relative to the spherical receiving part with the posture of the housing fixed. Thus, a sufficient degree of freedom in the pull-out direction of the electric wires is secured.

The rotation-holding part preferably has the cut-outs and cantilevered portions divided by the cut-outs. The cover is constructed of two half split parts divided along the axis of the housing, and each half split part is provided with the cantilevered portion. Thus, the rotation-holding part can be fit easily on the outer side of the spherical receiving part by mounting both half split parts of the cover on each other while the cantilevered portions are applied to the outer side of the spherical receiving part. Hence an excellent assembling operation can be performed.

The cover preferably includes a fixed-side cover fixedly mounted on the housing, and a movable-side cover mounted on a side of the fixed-side cover opposite to a side at which the fixed-side cover is mounted on the housing. The spherical receiving part is mounted on one of the fixed-side cover and the movable-side cover, and the rotation-holding part is mounted on the other of the fixed-side cover and the movable-side cover. In this construction, the pull-out direction of the electric wires W can be altered three-dimensionally by rotating the movable-side cover relative to the fixed-side cover about the axis of the housing and about the rotational axis orthogonal to the axis of the housing. This construction allows the terminal fittings to be accommodated in the housing before mounting the fixed-side cover or the rotation-holding part on the housing. Hence an operation of accommodating the terminal fittings is performed easily.

The rotation-holding part preferably has a symmetrical configuration with the cut-outs disposed at two positions spaced at an angular interval of 180 degrees. This construction allows the movable-side cover to rotate easily in both sides with respect to the rotational axis orthogonal to the axis of the housing when the movable-side cover is rotated about the rotational axis.

The housing or the cover preferably has a stop for preventing rotation of the cover before a gap is generated between the rotation-holding part and the spherical receiving part when the cover is rotated relative to the housing about the rotational axis orthogonal to the axis of the housing. Thus, the electric wires will not be exposed to the outside.

The cover preferably is divided along the axis of the housing and has two half split products with the same configuration. This construction decreases the manufacturing cost and facilitates the inventory control of parts.

The cover preferably has a corrugate-holding portion for surrounding the electric wires pulled out rearward from the movable-side cover and for holding an end of a flexible corrugate tube.

The invention provides the effect of diversifying the pull-out direction of the electric wire without increasing the kind of the cover.

DETAILED DESCRIPTION OF THE PREFERRED EMBODIMENTS

Figure 1:
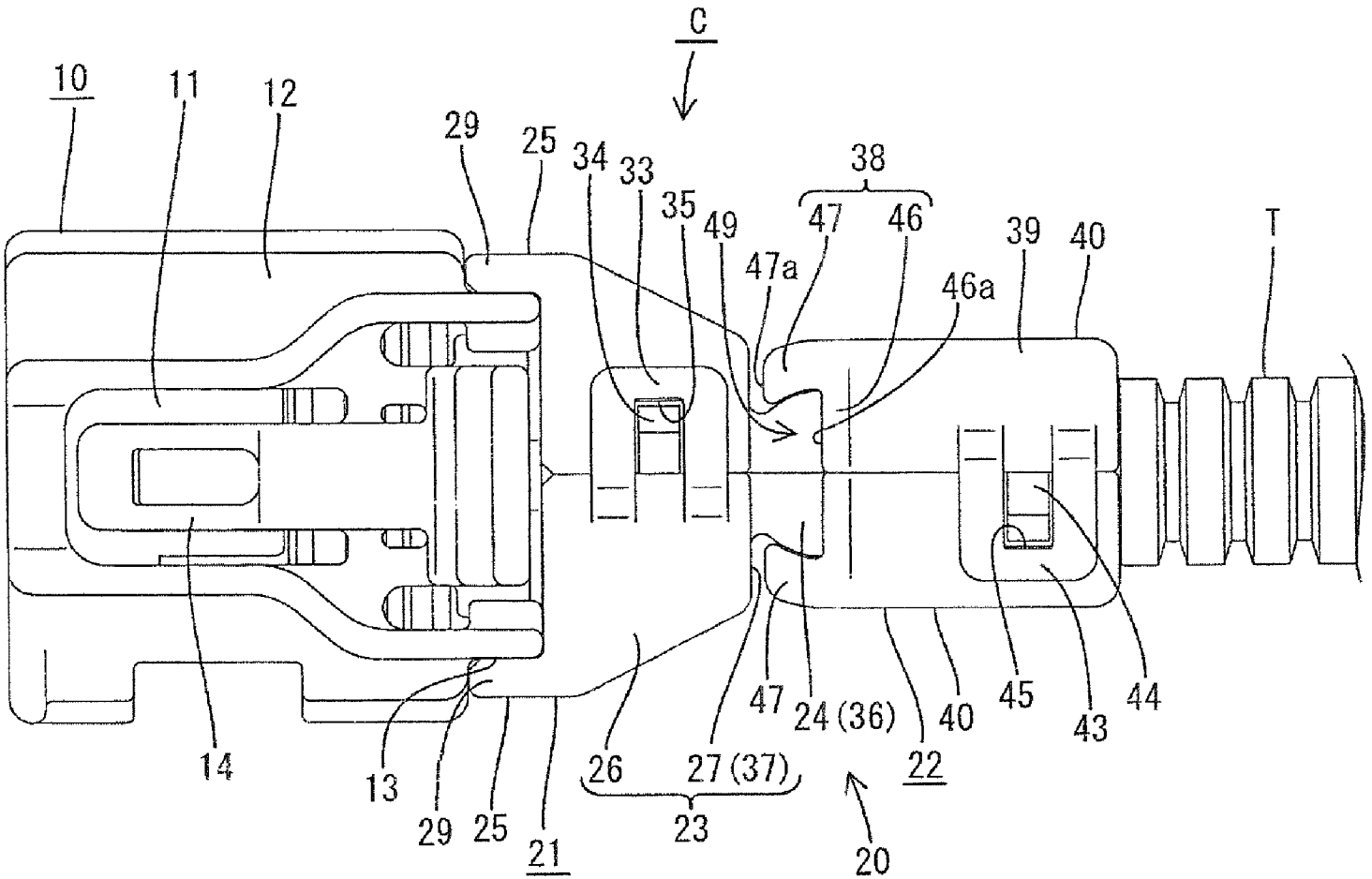
FIG. 1 is a plan view showing a connector of a first embodiment of the invention.
Figure 2:
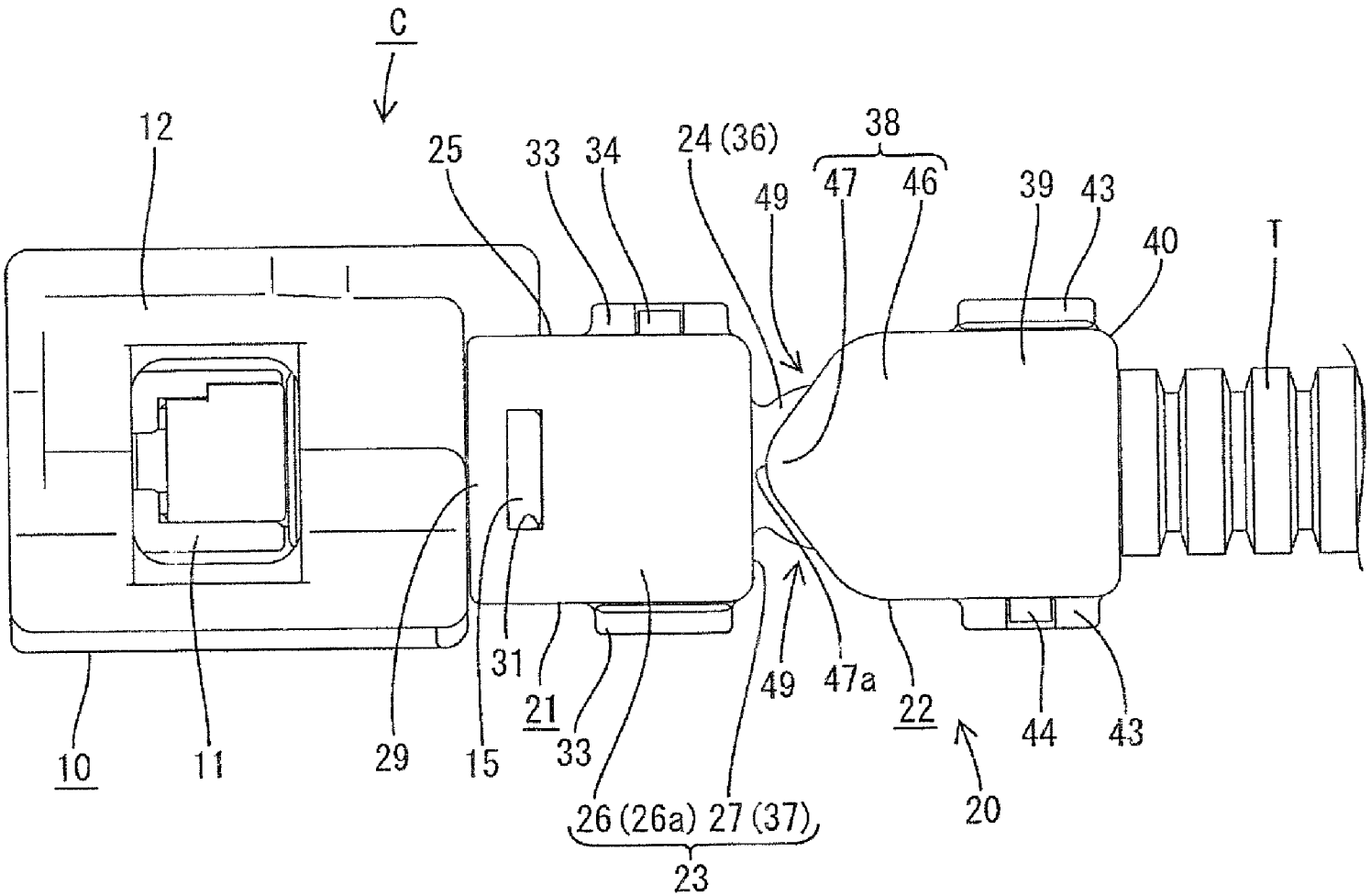
FIG. 2 is side view showing the connector.
Figure 3:
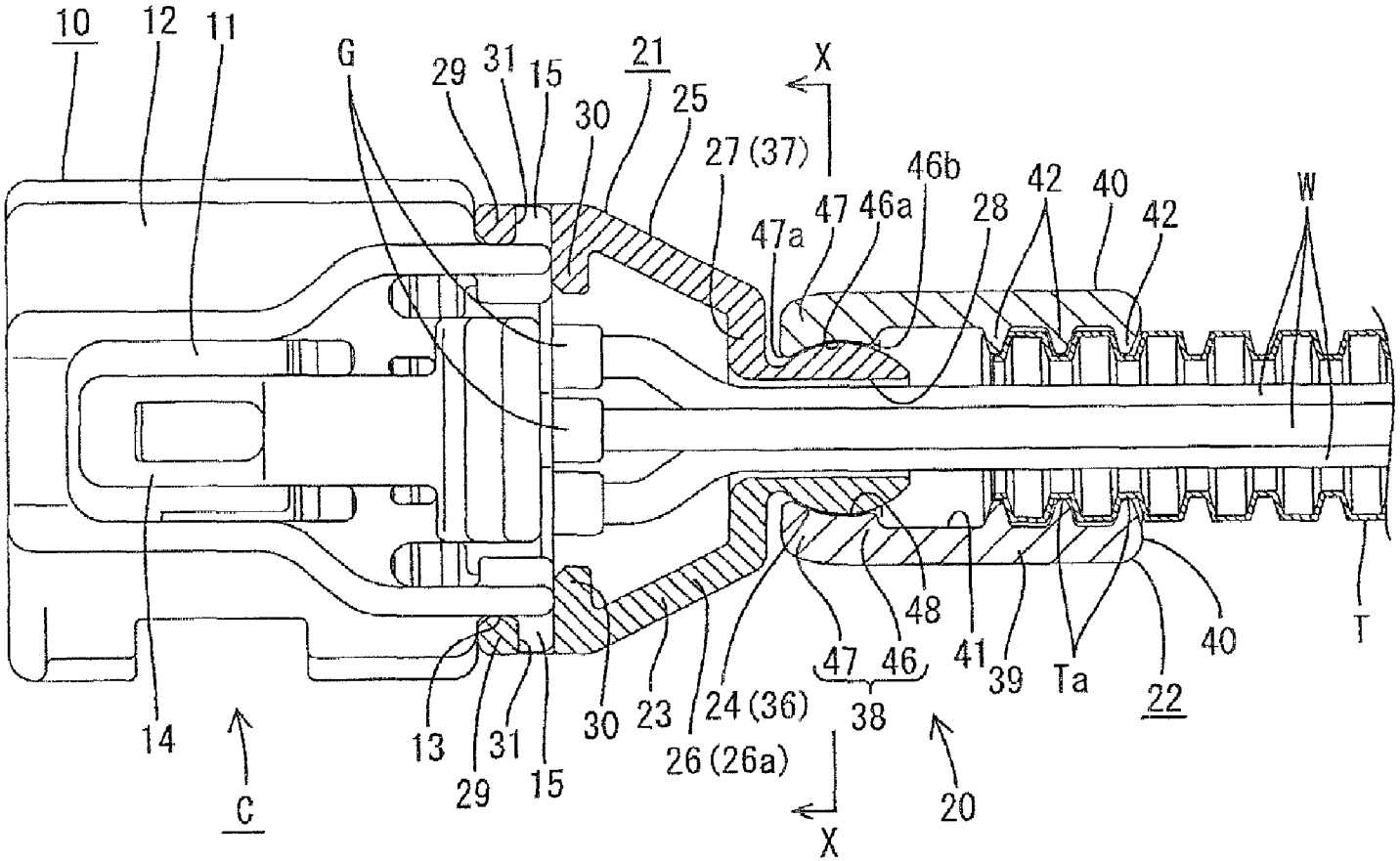
FIG. 3 is a plan sectional view showing a cover of the connector.
Figure 4:
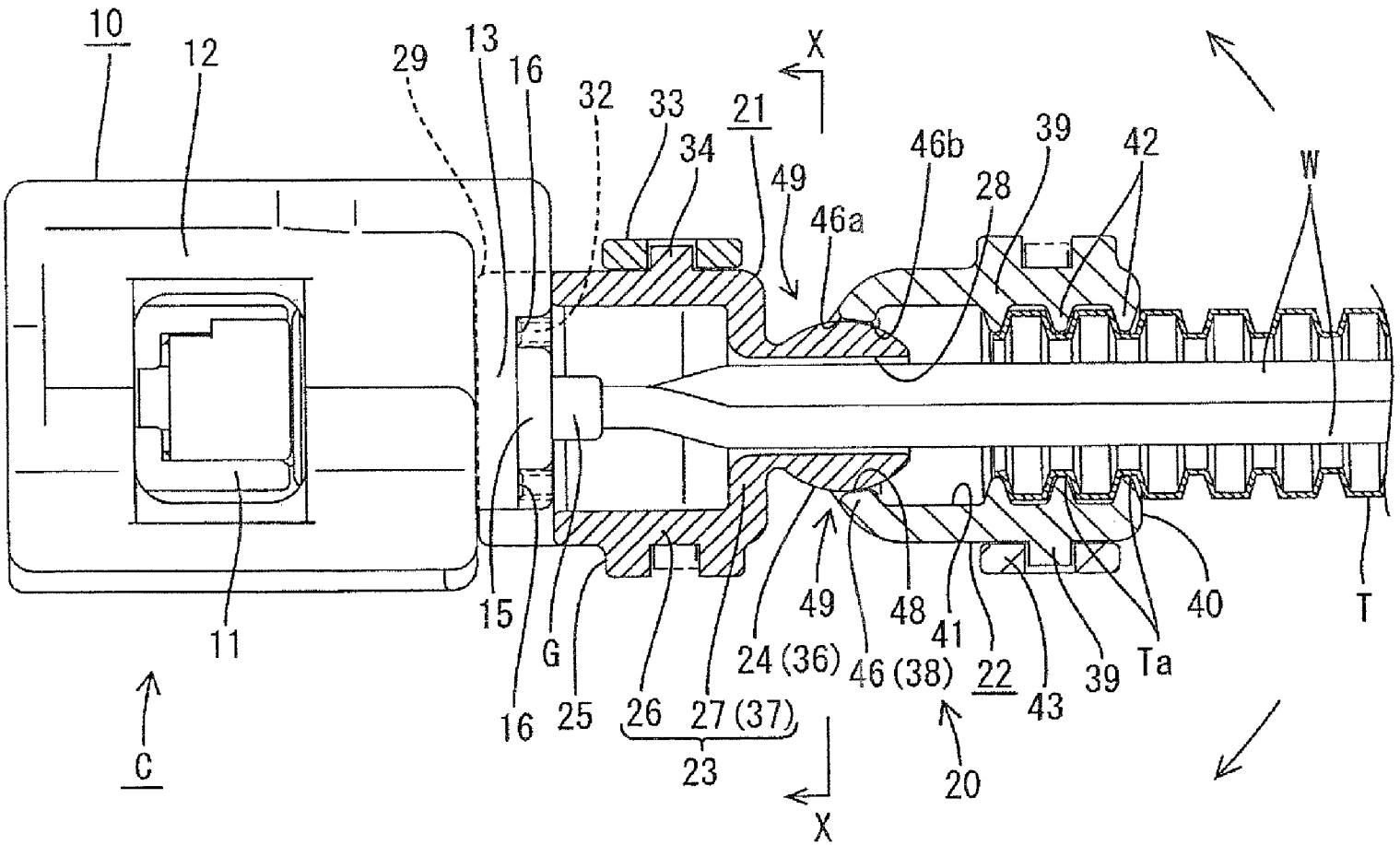
FIG. 4 is a side sectional view showing a cover of the connector.

A female connector in accordance with a first embodiment of the invention is identified by the letter C in FIGS. 1 through 19. The female connector C is intended for use in a wire harness in a car. In the following description, the fit-on end of the connector C (left side in FIGS. 1 and 2) is the "forward" end and the side opposite to the fit-on side (right side in FIGS. 1 and 2) is the "rearward" end. FIGS. 2 and 4 are set as the reference in a vertical direction.

As shown in FIGS. 1 through 4, the connector C includes a housing 10. Terminal fittings (not shown) are connected with the ends of electric wires W and are accommodated in the housing 10 so that the wires W are pulled out rearward from the housing 10. A cover assembly 20 is mounted at a rear portion of the housing 10 and surrounds the wires W. Part of the wires W rearward from the cover assembly 20 are surrounded with a bellows-shaped cylindrical corrugate tube T made of flexible synthetic resin. Thus, the cover assembly 20 and the tube T protect the wires W.

The housing 10 is made of synthetic resin and has a terminal fitting-accommodating part 11 with cavities (not shown) for receiving the terminal fittings. An approximately square pillar-shaped hood 12 is connected to the terminal fitting-accommodating part 11 and surrounds the terminal fitting-accommodating part 11 so that a gap is defined therebetween. A mating male connector can be fit in the gap between the terminal fitting-accommodating part 11 and the hood 12 from the front and along an axis that extends in the longitudinal direction of the housing 10. The terminal fitting-accommodating part 11 projects slightly rearward from the hood 12 to define a cover-mounting part 13. A locking arm 14 is formed on an upper wall of the hood 12 for holding the mating connector in a fit-on state.

Cavities are arranged side-by-side in the width direction of the housing 10 and penetrate the terminal fitting-accommodating part 11 straight in the longitudinal direction of the housing 10 so that the axis of each cavity aligns with the axial direction of the housing 10. The terminal fittings can be inserted into the cavities from the rear of the terminal fitting-accommodating part 11. Each terminal fitting has a terminal-connecting portion that can be connected electrically with a mating terminal in the mating connector. A wire-connecting portion is formed rearward of the terminal-connecting portion and can be crimped to an end of the electric wire W. The wire-connecting portion is caulked to a rubber plug G fit on an end of coating of the wire W and the rubber plug G projects slightly rearward from a rear end surface of the terminal fitting-accommodating part 11.

Two cover locks 15 project sideways from outer side surfaces of the cover-mounting part 13. The cover locks 15 are at a rear end of the cover-mounting part 13 and are spaced forward from a rear end surface of the hood 12. The cover locks 15 define vertically long narrow blocks. Two rearwardly open concave portions 16 are formed at positions of the cover-mounting part 13 adjacent to upper and lower portions of each cover lock 15.

The cover assembly 20 has a fixed cover 21 fixedly mounted on a rear end of the housing and a movable cover 22 mounted on a rear end of the fixed cover 21. A rotation-holding construction is provided at a portion where the fixed cover 21 and the movable cover 22 are connected to each other and holds the movable-side cover 22 rotatably relative to the fixed-side cover 21.

The fixed cover 21 is approximately cylindrical so that the wires W can be inserted therethrough. The fixed cover 21 has a fixed cover body 23 mounted on the cover-mounting part 13 at the rear end of the housing 10 so that the fixed cover body 23 surrounds a space rearward from the cover-mounting part 13. The fixed cover 21 also has a spherical receiving part 24 on which the movable cover 22 is mounted. The fixed cover body 23 and the spherical receiving part 24 are joined longitudinally to each other. The fixed cover 21 is defined by mounting two fixed cover halves 25 on each other so that the fixed cover halves 25 meet at a central position in the widthwise direction of the fixed-side cover 21. Both fixed cover halves 25 have the same configuration. Each of the fixed cover halves 25 includes half of the fixed cover body 23 and half of the spherical receiving part 24 longitudinally coupled to the half of the fixed cover body 23.

As shown in FIGS. 3, 4, 7, and 8, the fixed cover body 23 has a square pillar-shaped peripheral wall 26 surrounding the wires W pulled out of the rear end of the housing 10 and a rear wall 27 connected with a rear end of the peripheral wall 26. A circular wire insertion hole 28 is formed longitudinally through the rear wall 27 and can receive the wires W. The height of the peripheral wall 26 is constant over the full length thereof, whereas the width of the peripheral wall 26 gradually decreases towards the rear end. Accordingly, the width of an electric wire insertion space inside the peripheral wall 26 gradually decreases towards the rear, and the side walls **26*a* at both widthwise sides of the peripheral wall 26 incline in the longitudinal direction. The peripheral wall 26 is sectionally U-shaped on each of the fixed cover halves 25**.

A locking piece 29 projects forward from a front end of each of the side walls **26*a* of the peripheral wall 26 and a contact portion 30 projects in from the front end of each of the side walls 26*a*. The contact portion 30 has a height equal to the height of the fixed-side cover 21 over the full length thereof. The contact portion 30 contacts the rear end surface of the housing 10 to prevent the fixed-side cover 21** from moving forward.

The height dimension (equal to the height of the fixed cover body 23) of the locking piece 29 is longer than the longitudinal length thereof. The locking piece 29 is cantilevered and elastically deformable in the width direction of the fixed cover body 23. A locking hole 31 is formed through the locking piece 29 in the thickness direction thereof and can receive the cover lock 15 of the housing 10. The fixed cover 21 is fixed to the housing 10 by locking the cover lock 15 to the peripheral edge of the locking hole 31. Two convexities 32 project in from inner positions of the locking piece 29 adjacent to upper and lower portions of the locking hole 31 and have projecting distances less than the height of the contact portion 30. The convexities 32 can fit in the concave portion 16 of the housing 10 while mounting the fixed-side cover 21 on the housing 10 so that the cover locks 15 can be placed vertically in position for the locking holes 31. A front end surface of the locking piece 29 can be brought into contact with the rear end surface of the hood 12 disposed in front of the locking piece 29.

One holding piece 33 and one holding portion 34 are provided at a split end of the peripheral wall 26 of each of the fixed cover halves 25 for holding both fixed cover halves 25 in an assembled state. More specifically, the holding piece 33 is provided on the outer surface of one of upper and lower split ends on the peripheral wall 26 and projects toward the mating fixed cover half 25. The holding portion 34 projects on the outer surface of the other of the upper and lower split ends on the peripheral wall 26. An open holding groove 35 is formed at the proximal side of the holding piece 33 and can receive the holding portion 34 of the mating fixed cover half 25. Both fixed cover halves 25 are held in an assembled state by locking the holding portion 34 to the edge of the holding groove 35.

The spherical receiving part 24 has a spherical outer peripheral surface 36 and the wire insertion hole 28 penetrates centrally through the spherical receiving part 24 with a constant inside diameter along its length. Thus, the spherical receiving part 24 defines a tube with a varying thickness along its length. The thickness of the spherical receiving part 24 is largest at the longitudinal center and gradually becomes smaller toward its front and rear ends, with a minimum thickness at its rear end. Accordingly, the peripheral surface 36 of the spherical receiving part 24 is at a radially outermost position at the longitudinal center thereof and gradually defines smaller radial loci towards the front and rear ends thereof, with the innermost radial position defined at the rear end thereof. The front end of the spherical receiving part 24 is coupled to the rear wall 27 with an increased thickness to define sufficient strength for the front end of the spherical receiving part. The spherical receiving part 24 is approximately bow-shaped in its sectional configuration and approximately symmetrical with respect to the center in the longitudinal direction. The rear end surface of the spherical receiving part 24 is substantially a radially aligned plane.

The spherical receiving part 24 is coupled to the central position of the rear wall 27 of the fixed cover body 23. The maximum outer diameter of the spherical receiving part 24 is set smaller than the height and width of the rear wall 27. Thus, the rear wall 27 of the fixed cover body 23 projects out beyond the spherical receiving part 24 in the height and width directions thereof. A stop 37 is defined at a peripheral part of the rear wall 27 connected with the spherical receiving part 24 and interferes with the movable cover 22 to limit rotation of the movable cover 22, as described later.

Figure 11:
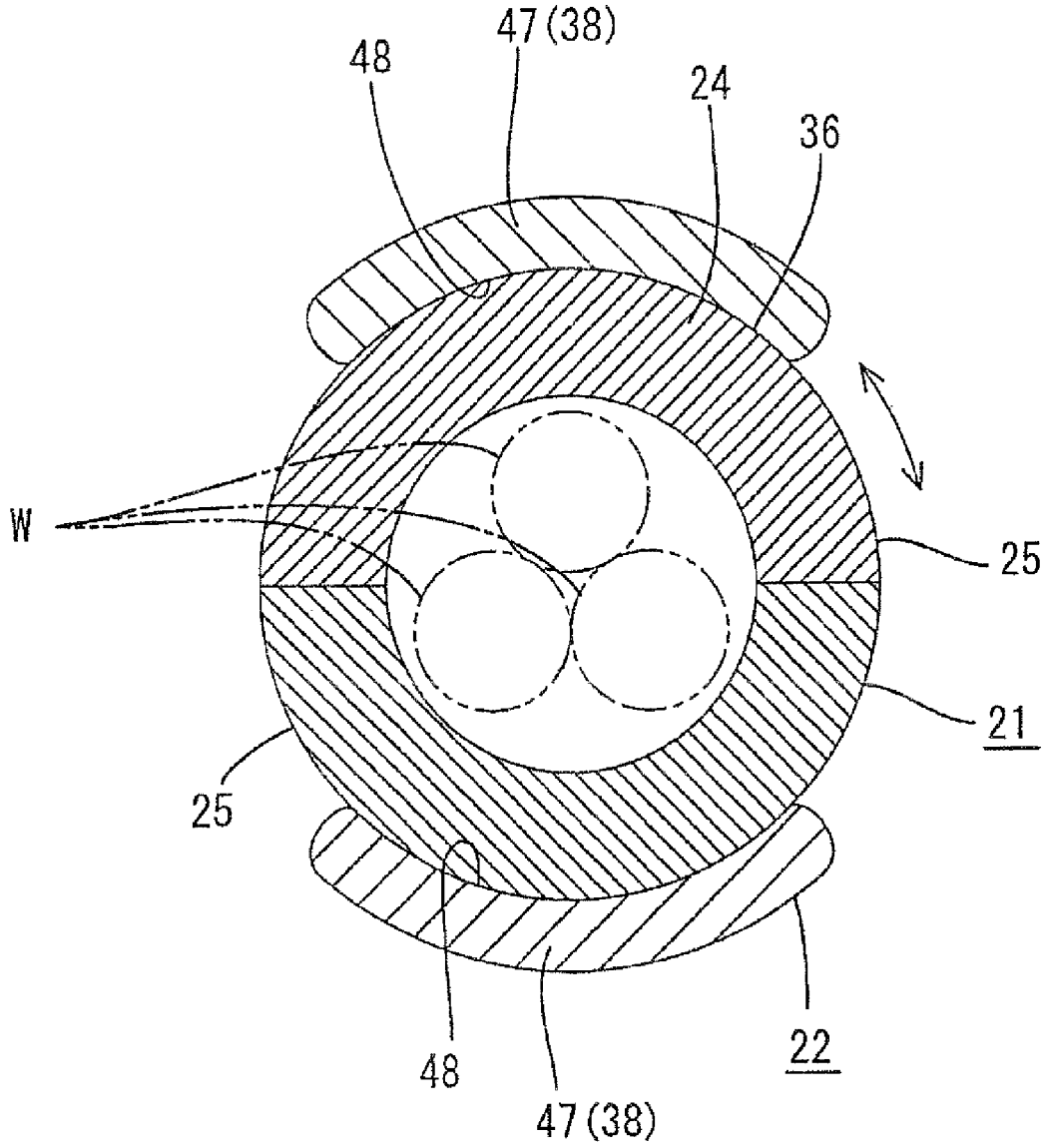
FIG. 11 is a sectional view taken along a line X-X in FIGS. 3 and 4.

The wire insertion hole 28 is formed continuously with the rear wall 27 of the fixed cover body 23. As shown in FIG. 11, three wires W are inserted through the electric wire insertion hole 28 and are bundled so that the axes of the wires W are disposed at the apexes of a triangle. The diameter of the electric wire insertion hole 28 is slightly larger than the diameter of a circle passing through the outermost positions on the triangular group of wires W. The longitudinal dimension of the spherical receiving part 24 depends on the diameter of the wire insertion hole 28. More particularly, the longitudinal dimension of the spherical receiving part 24 is made shorter if the diameter of the wire insertion hole 28 is made larger to accommodate the wires W. In detail, the longitudinal dimension of the spherical receiving part 24 is the root of the value found by subtracting the square of the diameter of the wire insertion hole 28 from the square of the diameter of the spherical receiving part 24.

As shown in FIGS. 3, 4, 9, and 10, the movable cover 22 is approximately tubular so that the wires W can be inserted therethrough. The movable cover 22 includes a rotation-holding part 38 and a movable cover body 39. The rotation-holding part 38 includes the rotation-holding construction and is fit on the spherical receiving part 24 of the fixed cover 21 from the outer side thereof. The movable cover body 39 is rearward of the fixed cover 21 and surrounds the wires W. The rotation-holding part 38 and the movable cover body part 39 are longitudinally coupled to each other. The movable cover 22 is formed by mounting two identical movable cover halves 40 on each other. The movable cover halves 40 are formed by longitudinally dividing the movable-side cover 22 at a central position in the widthwise direction thereof. Each of the movable cover halves 40 is constructed of half of the rotation-holding part 38 and half of the movable cover body part 39.

The movable cover body 39 has an approximately square pillar shape and a longitudinally open wire insertion hole 41 that receives, the wires W pulled rearward from the fixed cover 21. A corrugate tube-holding portion 42 projects in from the inner peripheral surface of the wire insertion hole 41. The outer peripheral surface of the movable cover body 39 is square, whereas the inner peripheral surface thereof is a circumferential surface. The corrugate tube-holding portion 42 annular and is sectionally mountain-shaped at three longitudinally spaced positions. The corrugate tube-holding portion 42 can be fit in concavities Ta formed on the peripheral surface of the corrugate tube T for holding the corrugate tube T.

One holding piece 43 and one holding portion 44 are provided at a split end of each of the movable cover halves 40 for holding both movable cover halves 40 in an assembled state. The holding groove 45 and the holding portion 44 of the holding piece 43 have the same construction as the holding piece 33 and the holding portion 34 the fixed-side cover 21. Therefore, the description of the holding piece 43 and the holding portion 44 are omitted herein. The disposition of the holding piece 43 and the holding portion 44 of the movable cover half 40 are reverse to that of the holding piece 33 and the holding portion 34 of the fixed cover half 25. The projected direction of the holding piece 33 of the fixed cover half 25 and that of the holding piece 43 of the movable cover half 40 are opposite to each other. Thus, it is difficult to disassemble the cover 20 even if a force of separating the fixed cover 25 and movable cover half 40 from each other acts on the cover 20 while the cover 20 is mounted on the housing 10,.

The rotation-holding part 38 has an approximately annular base 46 that projects forward from the movable cover body 39 and two cantilevered portions 47 project forward from the base 46. The inner peripheral surface 48 of the rotation-holding part 38 is spherical and conforms to the peripheral surface 36 of the spherical receiving part 24. In other words, two partially circumferential cut-outs 49 are formed at the front of the rotation-holding part 38 and have spherically generated inner peripheral surfaces 48 formed along the peripheral surface 36. Thus, the front end of the rotation-holding part 38 is separated into the two cantilevered portions 47.

The rotation-holding part 38 is fit on the spherical receiving part 24 from the outer side thereof, and is rotatable relative to the spherical receiving part 24 about the axis of the housing 10 (a direction shown with an arrow of FIG. 11). The cut-outs 49 are formed on the rotation-holding part 38, and hence the rotation-holding part 38 also is rotatable relative to the spherical receiving part 24 about a rotational axis orthogonal to the axis of the housing 10 (a direction shown with an arrow of FIG. 4).

Figure 9:
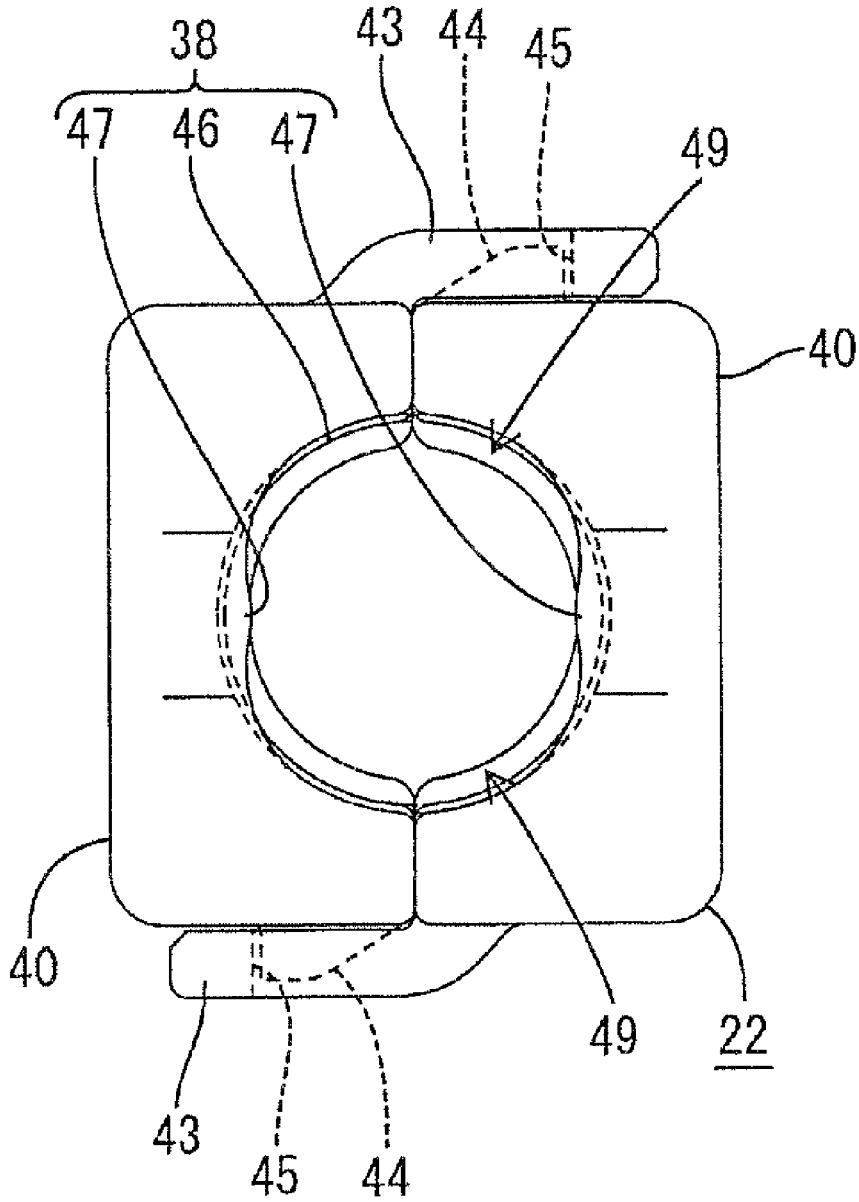
FIG. 9 is a front view showing a movable-side cover.
Figure 10:
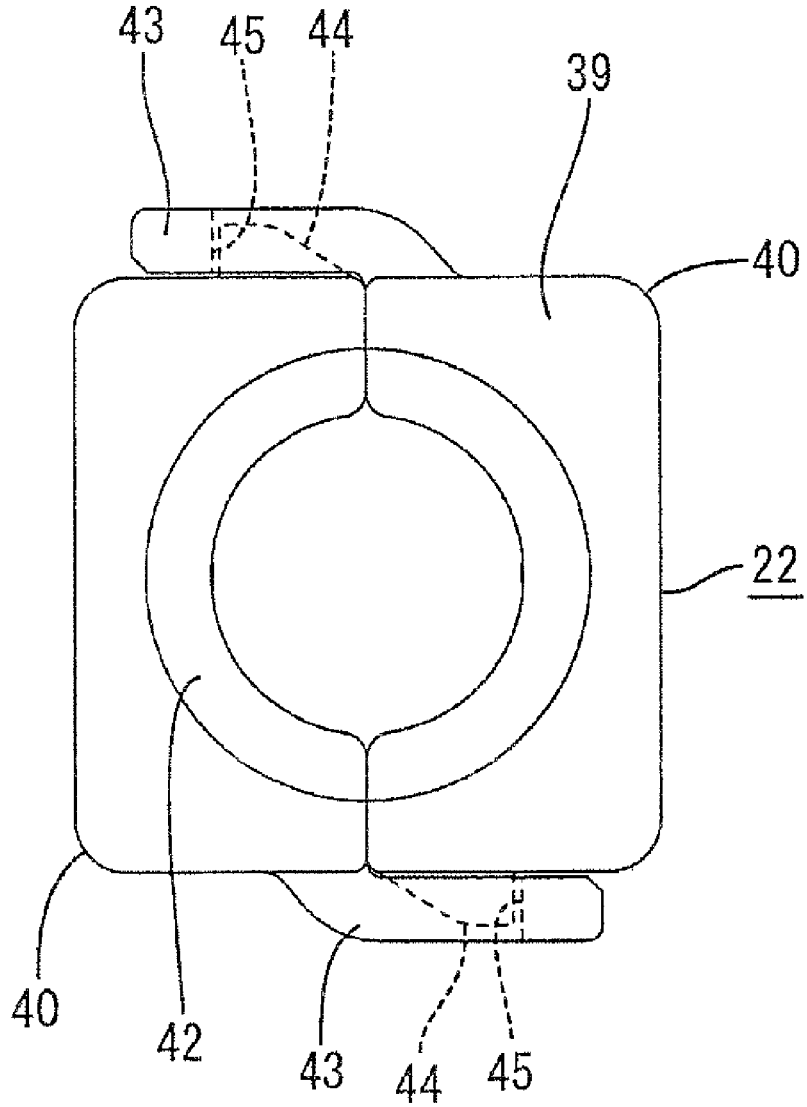
FIG. 10 is a rear view showing the movable-side cover.

More specifically, the rotation-holding part 38 has the two cut-outs 49 at positions spaced at an angular interval of about 180 degrees and the two cantilevers 47 at positions spaced at an angular interval of about 180 degrees between both cut-outs 49. The cut-outs 49 and the cantilevers 47 are disposed at an interval of approximately 90 degrees. The cut-outs 49 are disposed at upper and lower positions of the rotation-holding part 38, as shown in FIG. 9, whereas the cantilevers 47 are disposed at both sides of the rotation-holding part 38 in the widthwise direction so that one cantilever 47 is disposed on each of the movable cover halves 40 of the movable-side cover 22. As described above, the rotation-holding part 38 has a symmetrical configuration as a whole.

The base 46 has an approximately annular outer configuration in a rear side view and is capable of covering the entire periphery of the spherical receiving part 24. The widthwise dimension of the base 46 is longitudinally almost constant (see FIG. 1). However, the height of the base 46 gradually decreases to the front end due to the presence of the cut-out 49. Therefore, the base 46 tapers towards the front when the base 46 is viewed from the side in FIGS. 2, 4. The inner surface of the front end 46*a* of the base 46 is recessed outward to a highest extent. The inner surface of the base 46 in the range from the front end 46*a* to the rear end 46*b* thereof gradually projects inward, and the entire region of the base 46 projects inward beyond the inner peripheral surface of the movable cover body 39.

The cantilever 47 projects forward from both sides of the base 46 and tapers to gradually narrower widths towards the front end due to the presence of the cut-out 49. Thus, the cantilever 47 has a mountain-shape in a side view (see FIG. 2). The front-end surface of the cantilever 47 is round (see FIG. 2) and the inner peripheral surface 48 of the cantilever 47 is curved concavely (see FIG. 1). The inner surface of a front end 47*a* of the cantilever 47 projects inward to a maximum extent. The inner surface of the cantilever 47 in the range from the front end 47*a* to the rear end thereof is recessed gradually outward. The interval between the rear ends of both cantilevers 47, namely, the maximum widthwise dimension of the cut-out 49, is almost equal to the maximum outer diameter of the spherical receiving part 24 (see FIG. 1). The width of the cantilever 47 at its rear end exceeds the longitudinal dimension of the cantilever 47.

The longitudinal dimension of the cantilever 47 exceeds the longitudinal dimension of the base 46 and is approximately half the longitudinal dimension of the spherical receiving part 24. Thus the longitudinal dimension of the base 46 is less than the half of the longitudinal dimension of the spherical receiving part 24. Therefore the front end of the inner peripheral surface 48 of the base 46 and the inner surface of the front end 47*a* of the cantilever 47 project in beyond the inner surface of the rear end 46*b* of the base 46. The boundary of the inner surface 48 between the front end 46*a* of the base 46 and the cantilever 47 is coincident with the apex position (position recessed outermost to a high extent) on the spherical surface.

The front end 46*a* of the base 46 (the rear end of the cantilevers 47) is at the longitudinal central portion of the spherical receiving part 24 when the rotation-holding part 38 is mounted on the spherical receiving part 24 with the axes of the fixed cover 21 and the movable cover 22 aligned, as shown in FIGS. 1 through 4. In this state, almost the entire rear half of the spherical receiving part 24 is covered by the base 46 and the movable cover body 39, whereas the front half of the spherical receiving part 24 is covered partly by the cantilevers 47. In this state, the front ends 47*a* of the cantilevers 47 are directly rearward from the rear wall 27 of the fixed cover body 23, whereas the front end 46*a* of the base 46 is between the fixed cover body 23 and the rear wall 27, where a space for the cut-out 49 is formed. The penetration of the base 46 into the space for the cut-out 49 enables the rotation-holding part 38 to rotate relative to the spherical receiving part 24 about the rotational axis orthogonal to the axis of the housing 10. At this time, the rotation-holding part 38 is rotatable in the two directions shown with arrows of FIG. 4.

When the rotation-holding part 38 rotates about the rotational axis, the front side of the base 46 in the rotational direction moves forward, whereas the side of the base 46 opposite the front side moves rearward. The spherical receiving part 24 projects rearward beyond the base 46 (see FIGS. 3, 4) when the movable-side cover 22 is in a straight posture. Thus when the side of the base 46 opposite to the front side thereof in the rotational direction moves rearward, the electric wire W is protected with the portion of the spherical receiving part 24 projected beyond the base 46.

Figure 12:
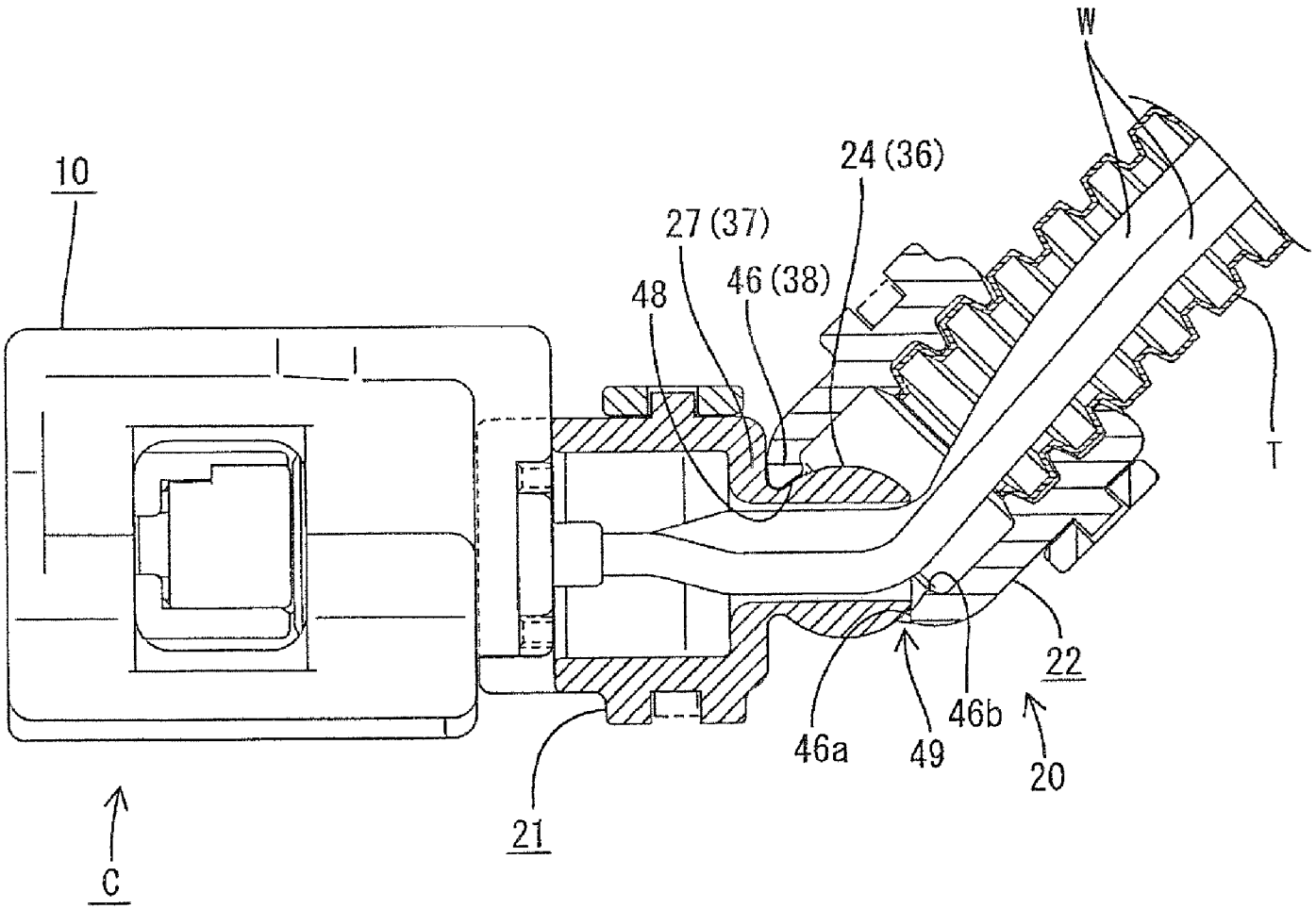
FIG. 12 is a side sectional view showing a state in which wires are pulled out up.
Figure 13:
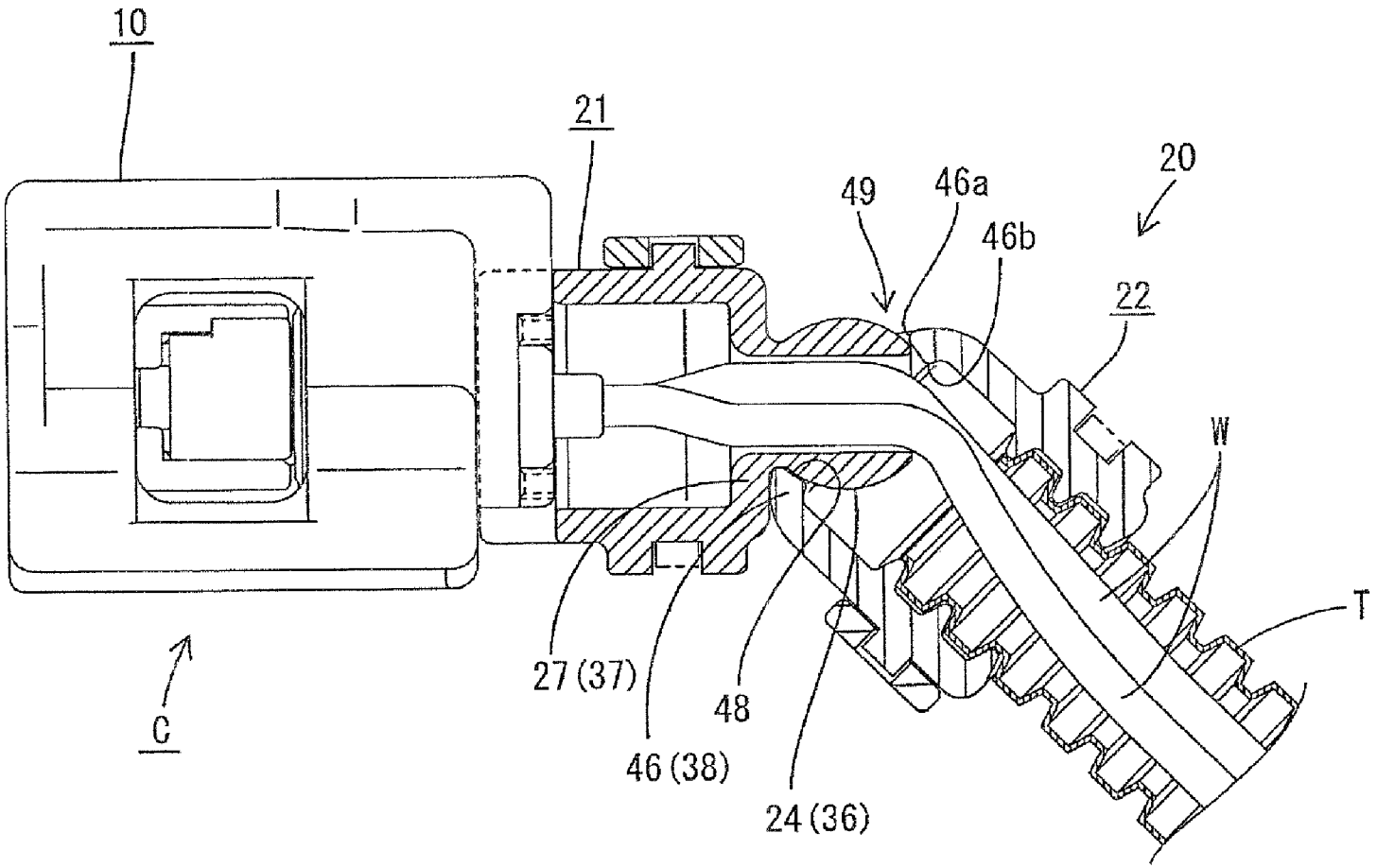
FIG. 13 is a side sectional view showing a state in which electric wires are pulled out downward.
Figure 14:
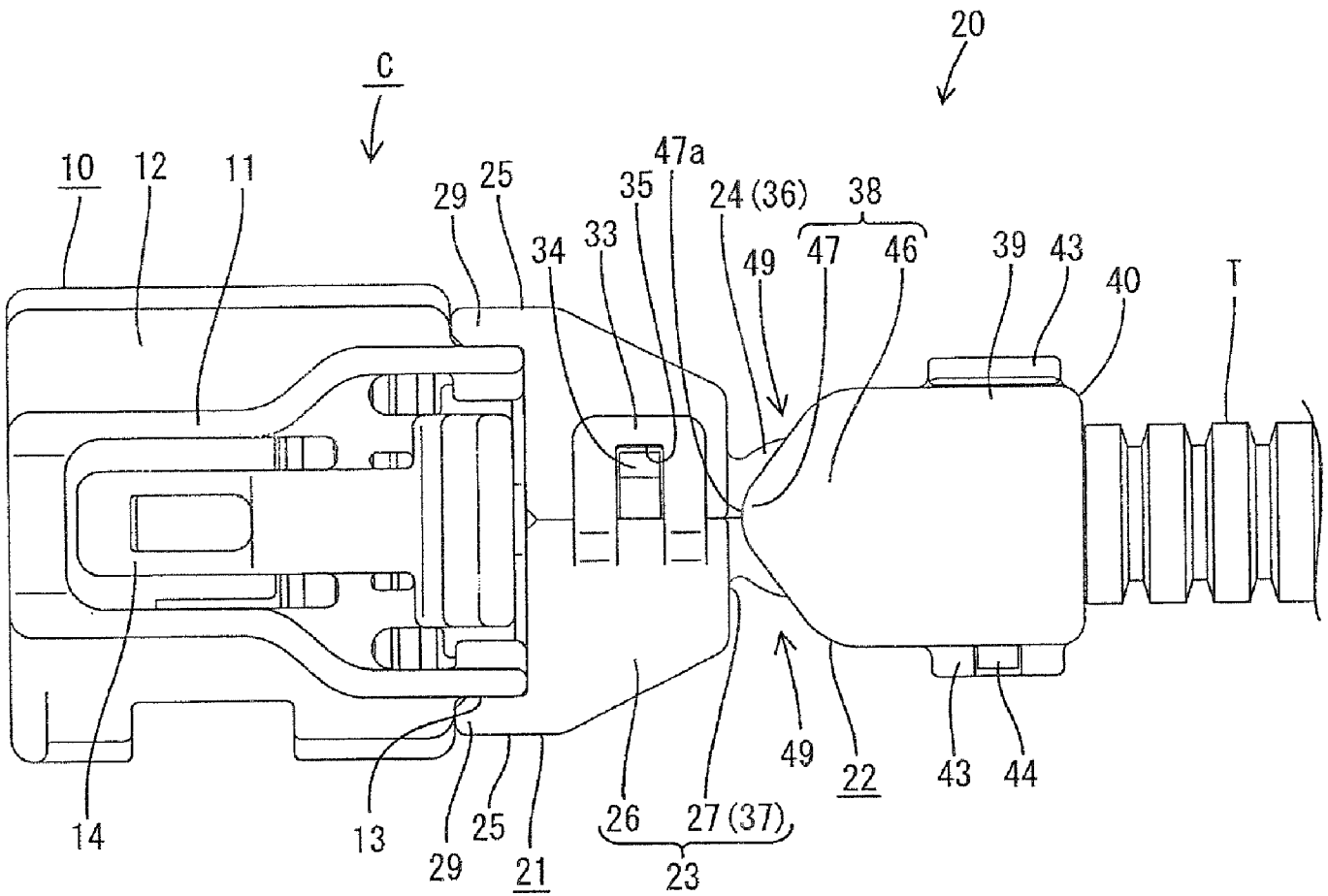
FIG. 14 is a plan view showing a state in which the movable-side cover is postured to turn a cut-out laterally.
Figure 15:
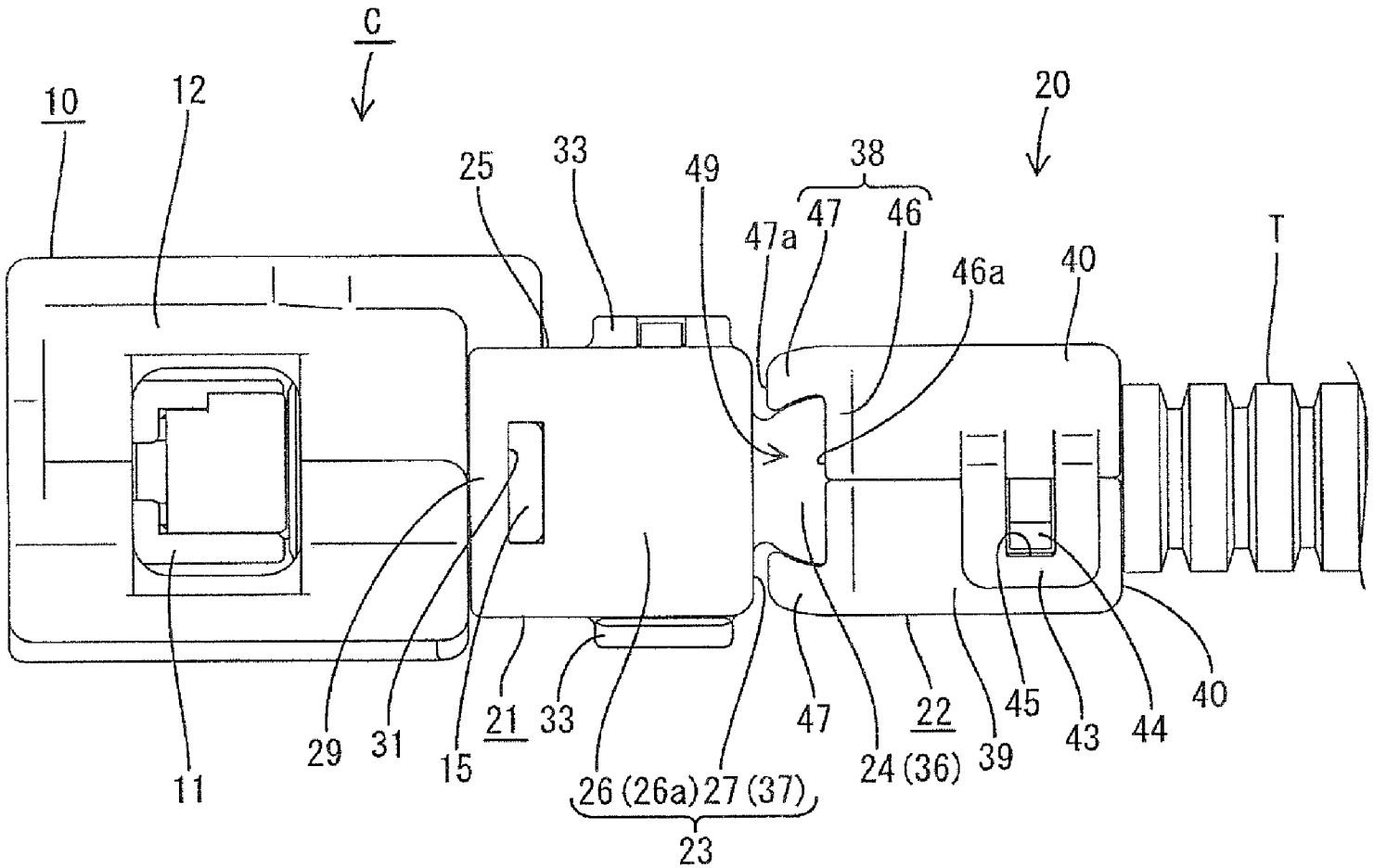
FIG. 15 is a side view showing the state in which the movable-side cover is postured to turn the cut-out laterally.
Figure 16:
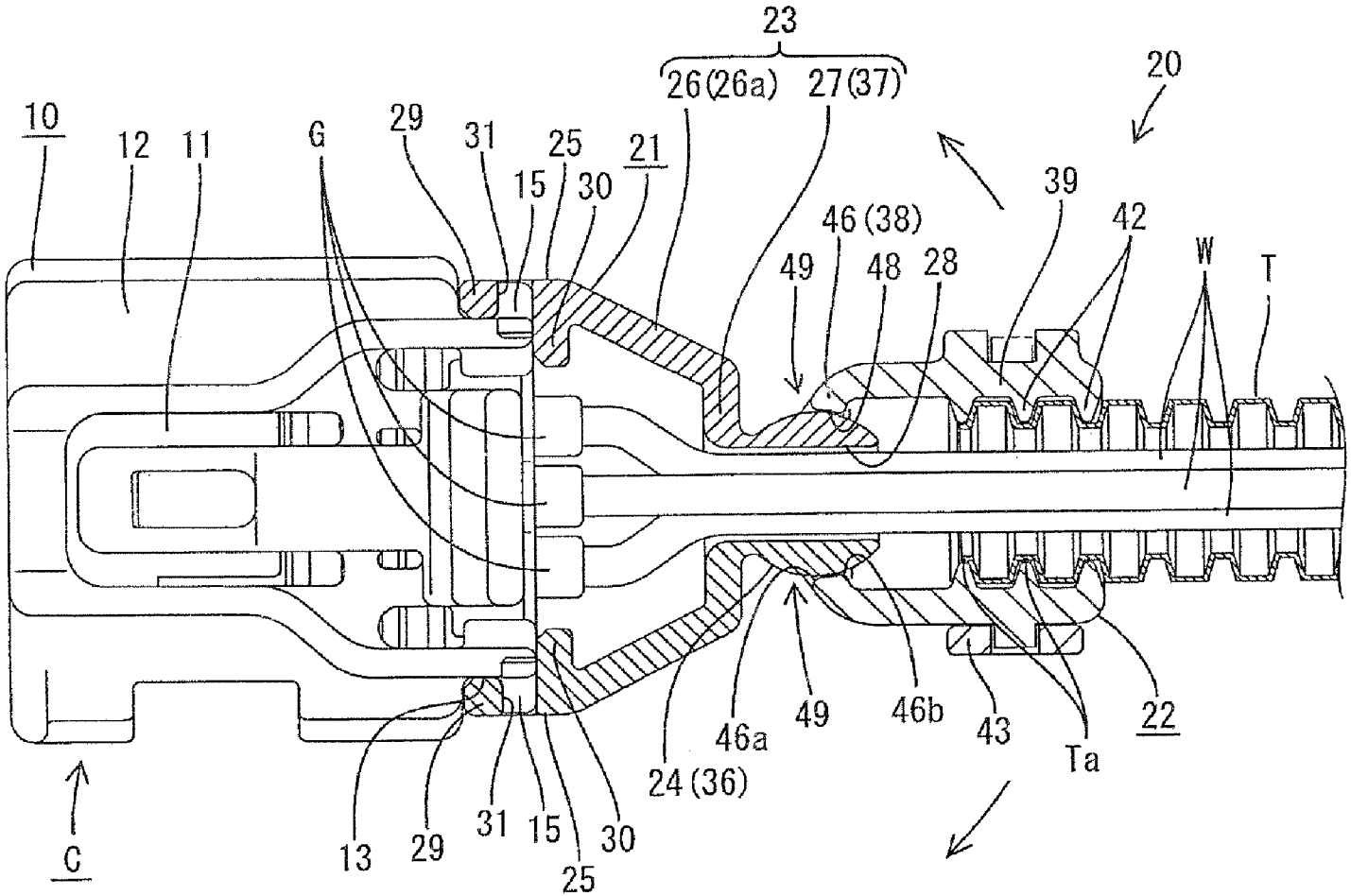
FIG. 16 is a plan sectional view showing the state in which the movable-side cover is postured to turn the cut-out laterally.
Figure 17:
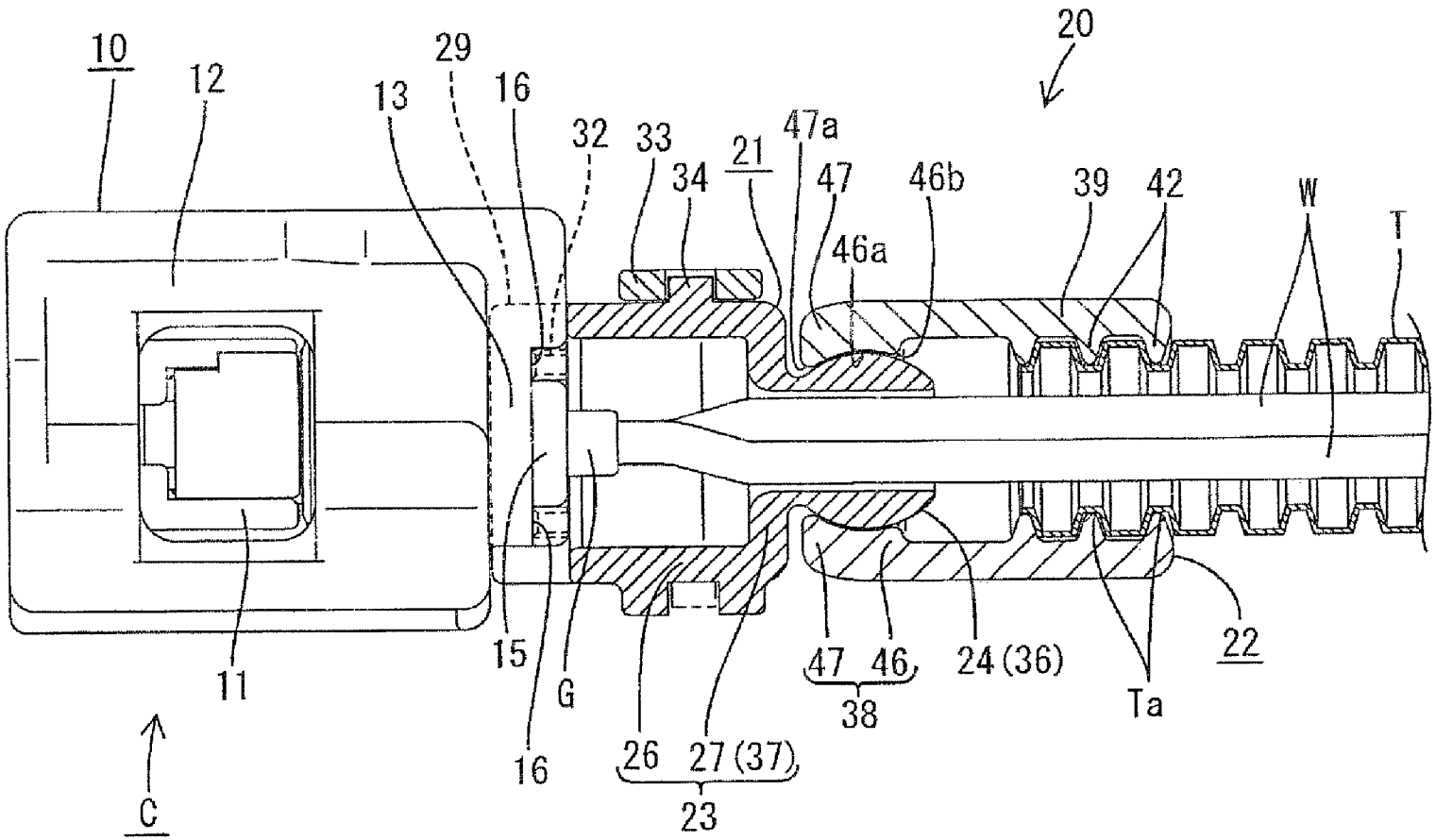
FIG. 17 is a side sectional view showing the state in which the movable-side cover is postured to turn the cut-out laterally.
Figure 18:
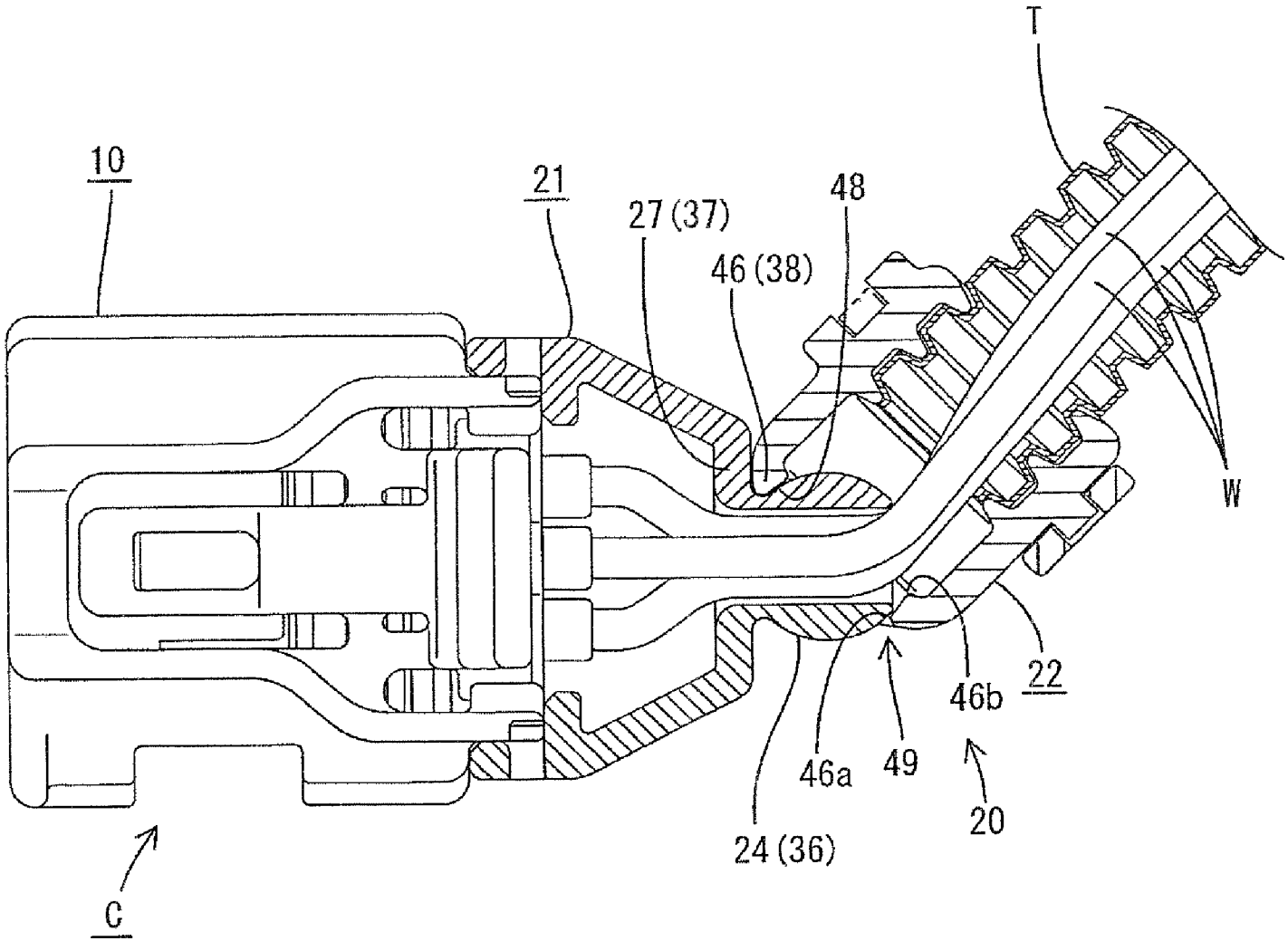
FIG. 18 is a plan sectional view showing a state in which the electric wire is pulled out to a lateral rear side.
Figure 19:
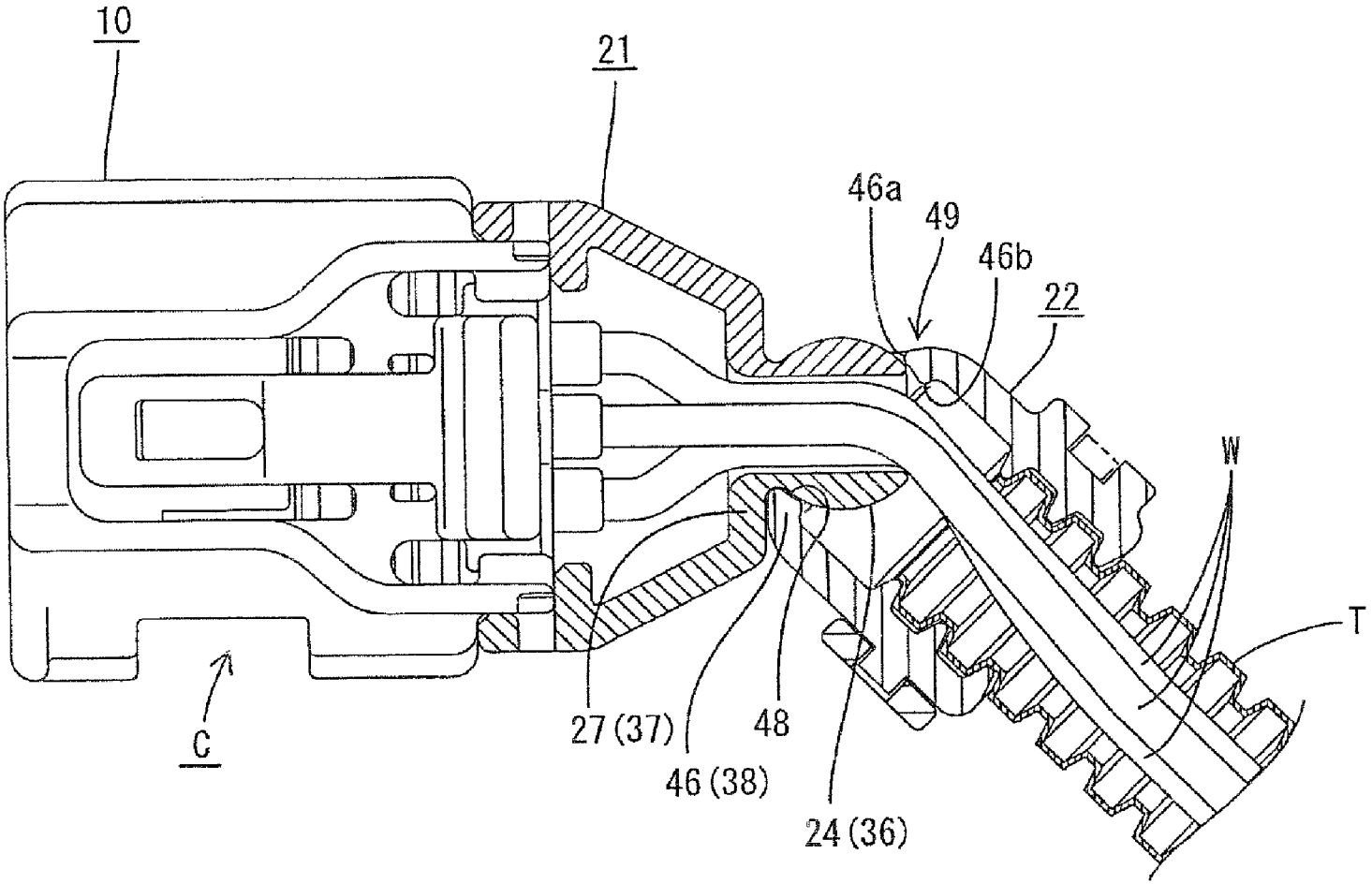
FIG. 19 is a plan sectional view showing a state in which the electric wire is pulled out to a lateral front side.
Figure 20:
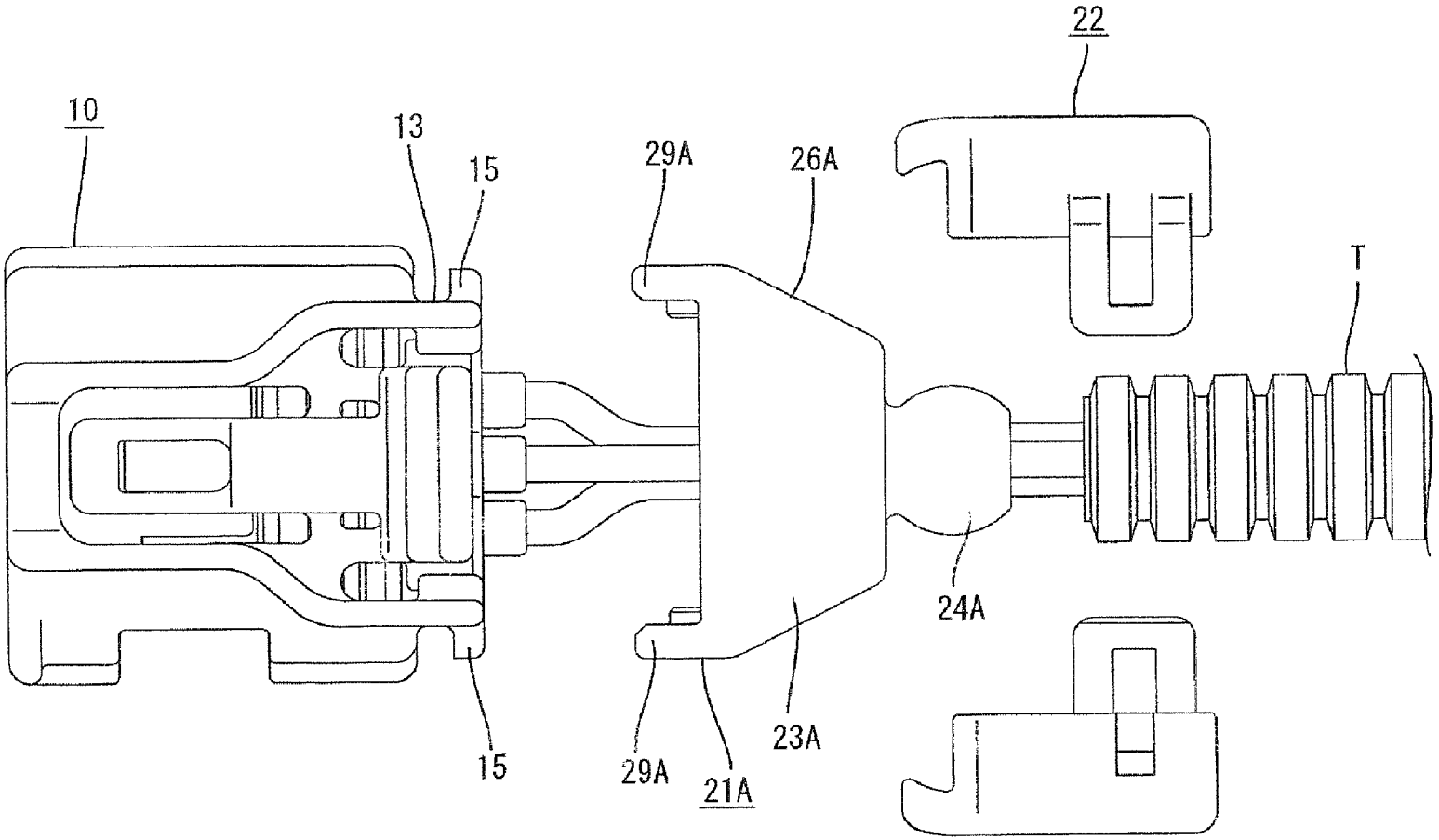
FIG. 20 is a plan view showing a state in which a cover of a connector according to a second embodiment of the invention is exploded.
Figure 21:
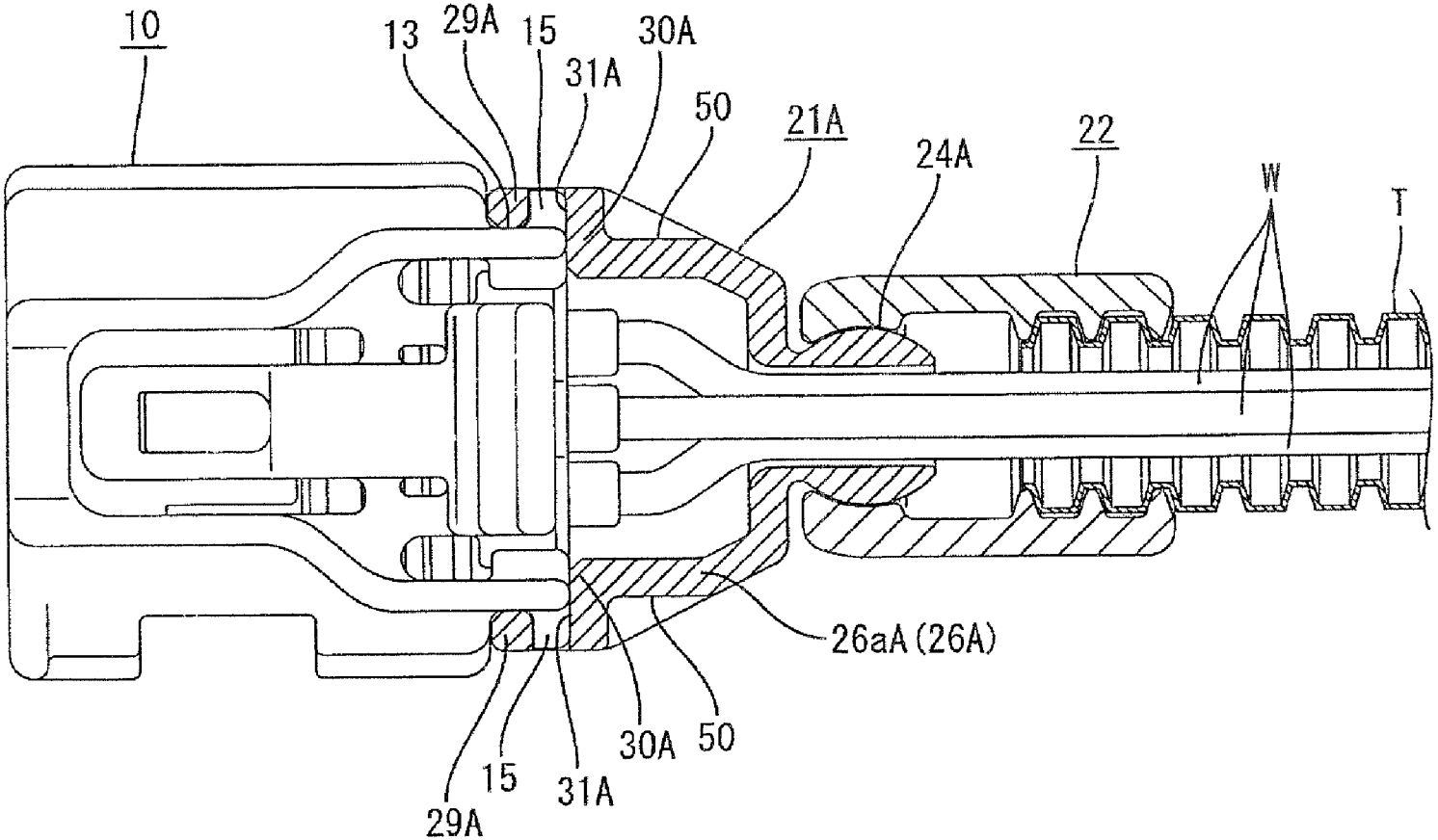
FIG. 21 is a plan sectional view showing a state in which a cover is mounted on a housing.
Figure 22:
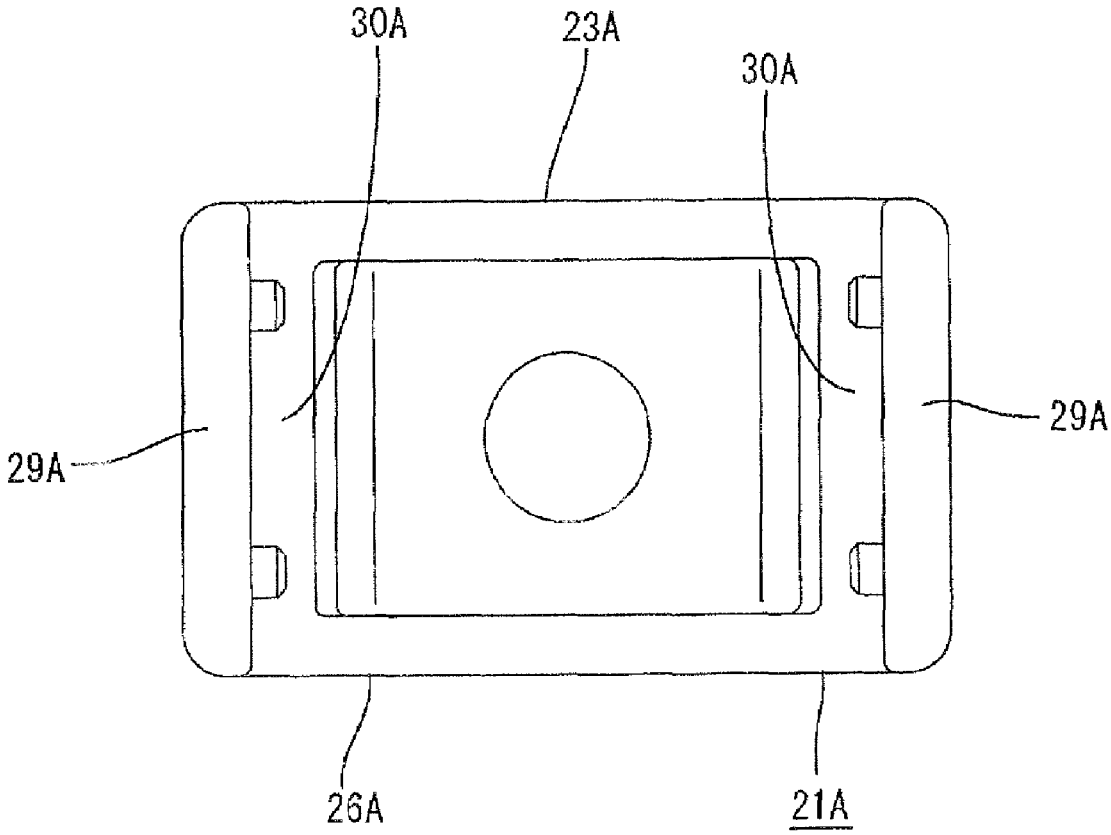
FIG. 22 is a front view showing a fixed-side cover.
Figure 23:
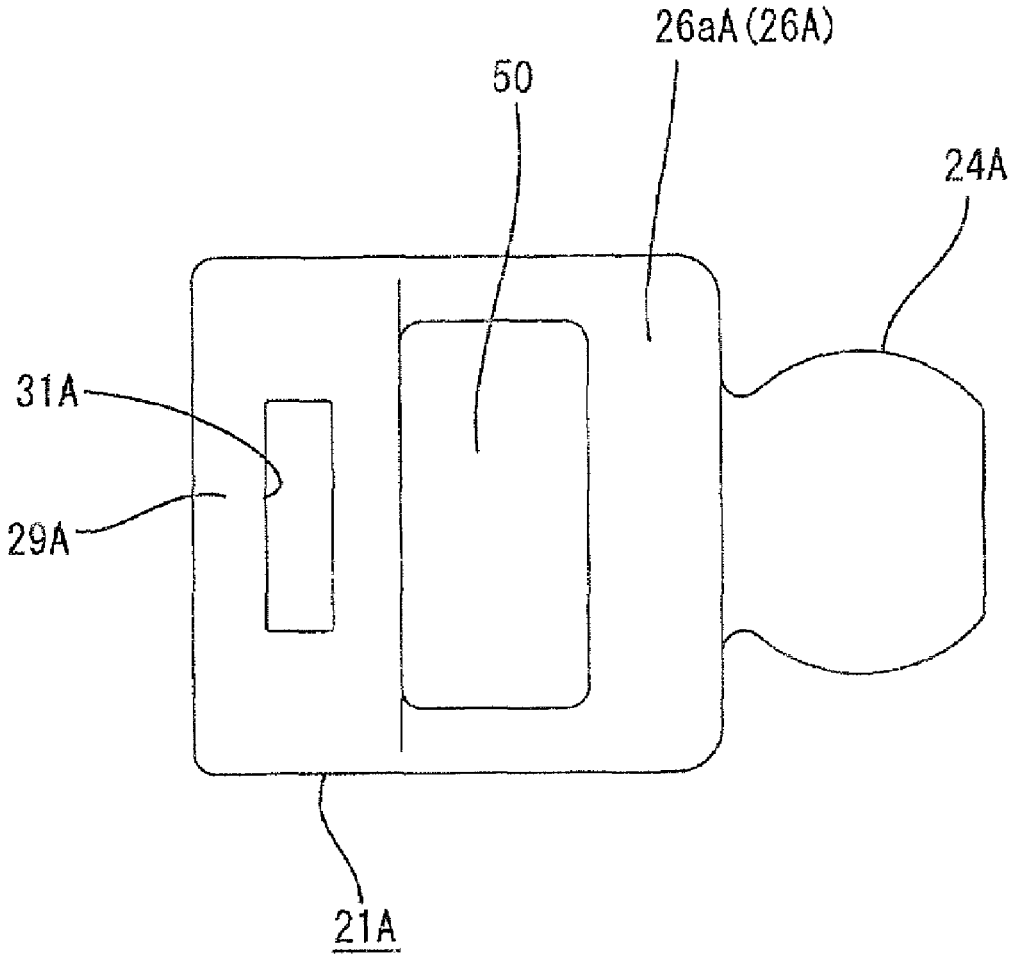
FIG. 23 is a side view showing the fixed-side cover.
Figure 24:
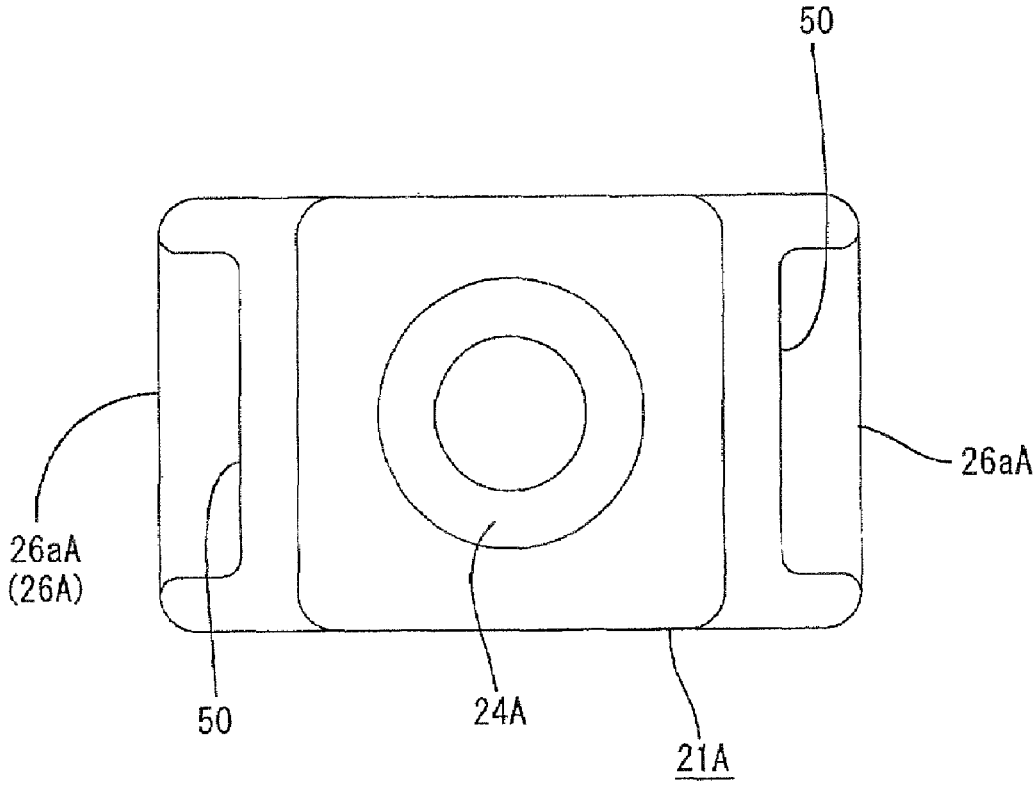
FIG. 24 is a rear view showing the fixed-side cover.
Figure 25:
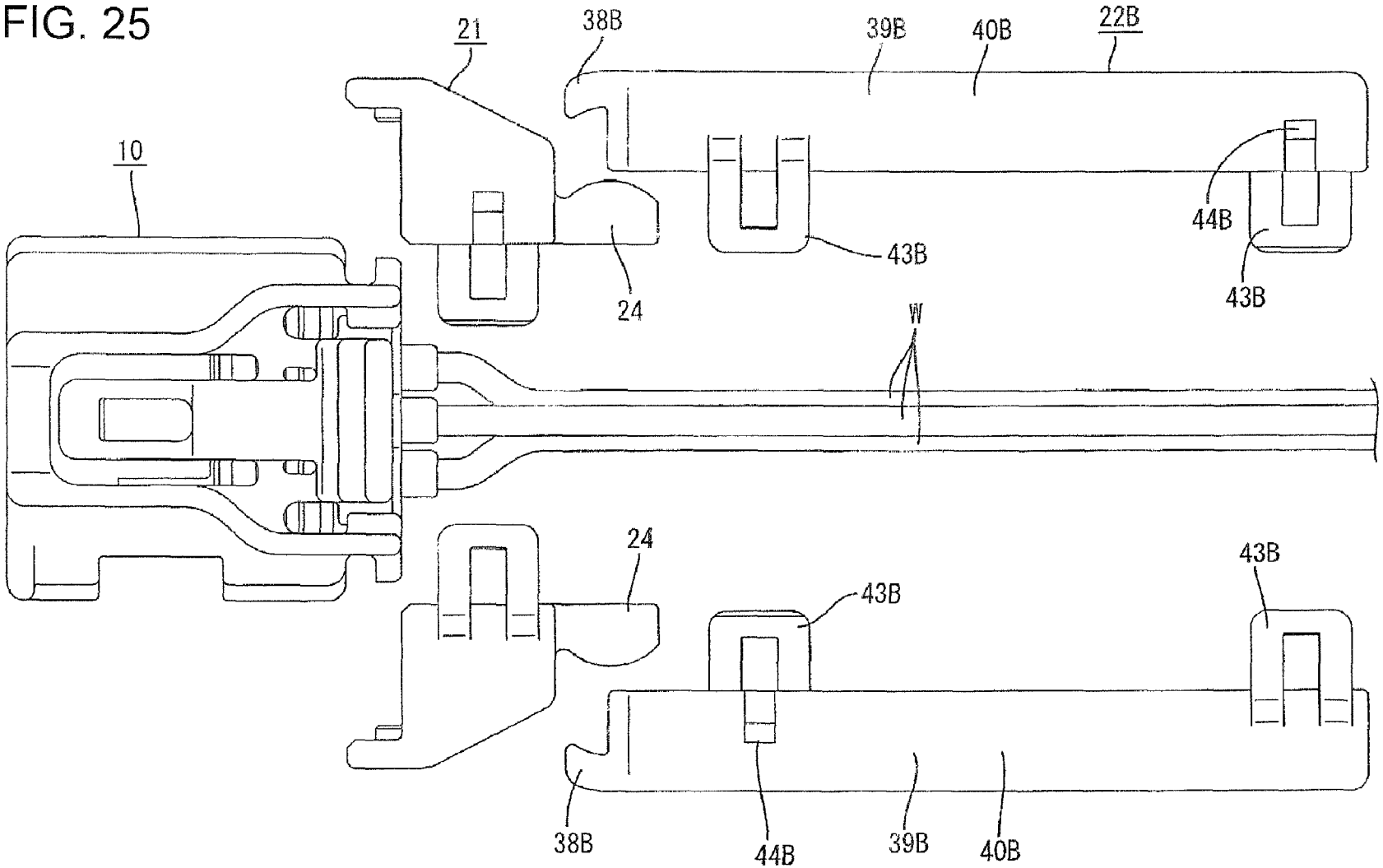
FIG. 25 is a plan view showing a state in which a cover of a connector according to a third embodiment of the invention is exploded.
Figure 26:
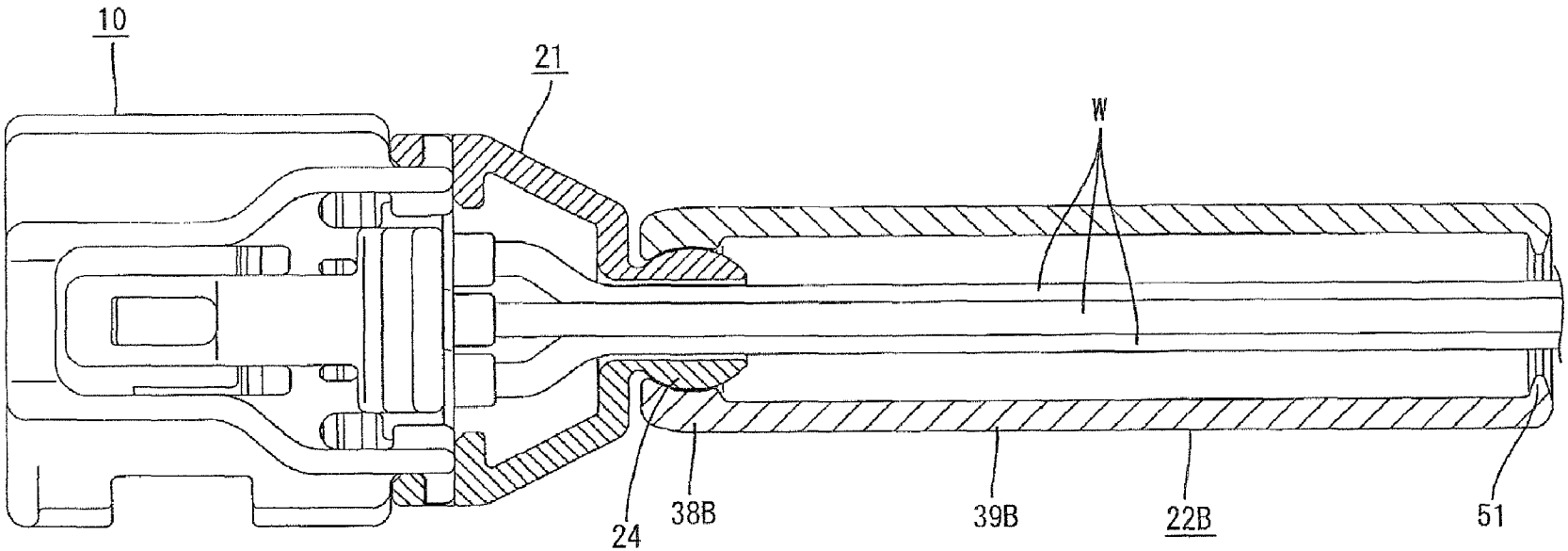
FIG. 26 is a plan sectional view showing a state in which a cover is mounted on a housing.
Figure 27:
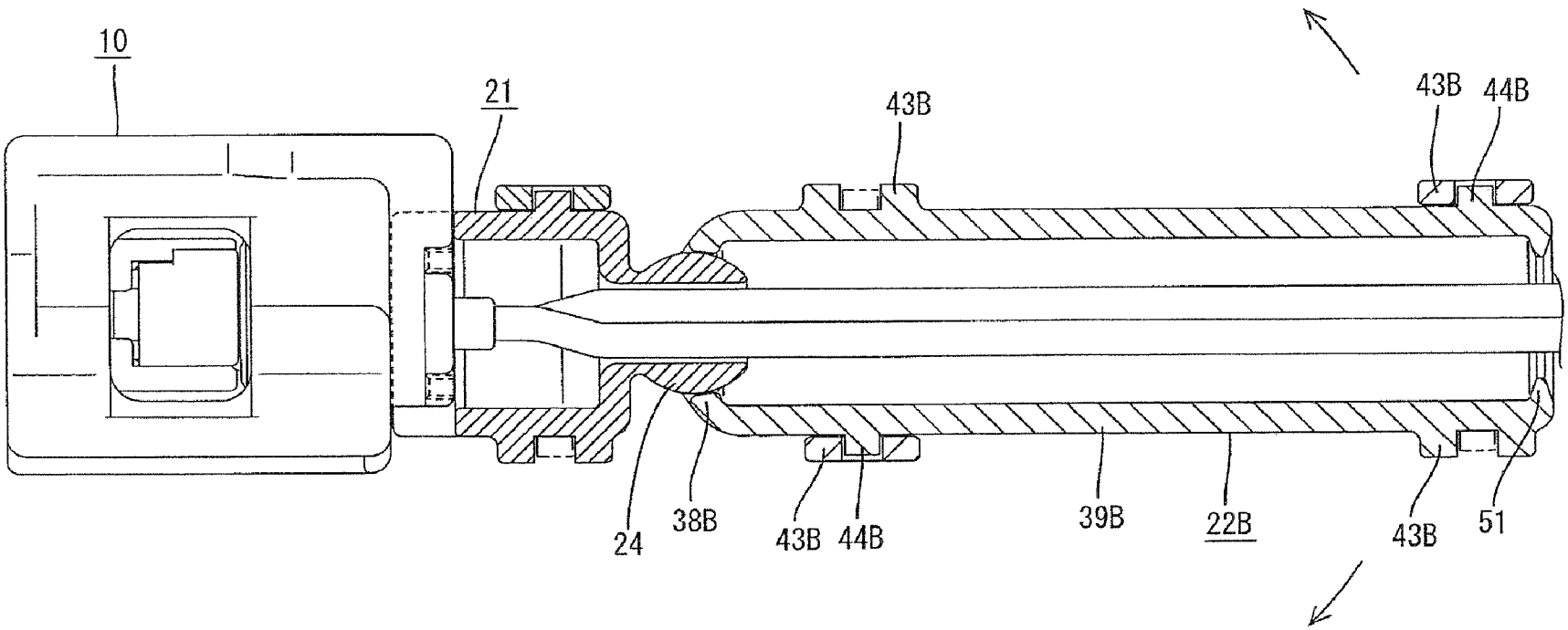
FIG. 27 is a side sectional view showing a state in which the cover is mounted on the housing.
Figure 28:
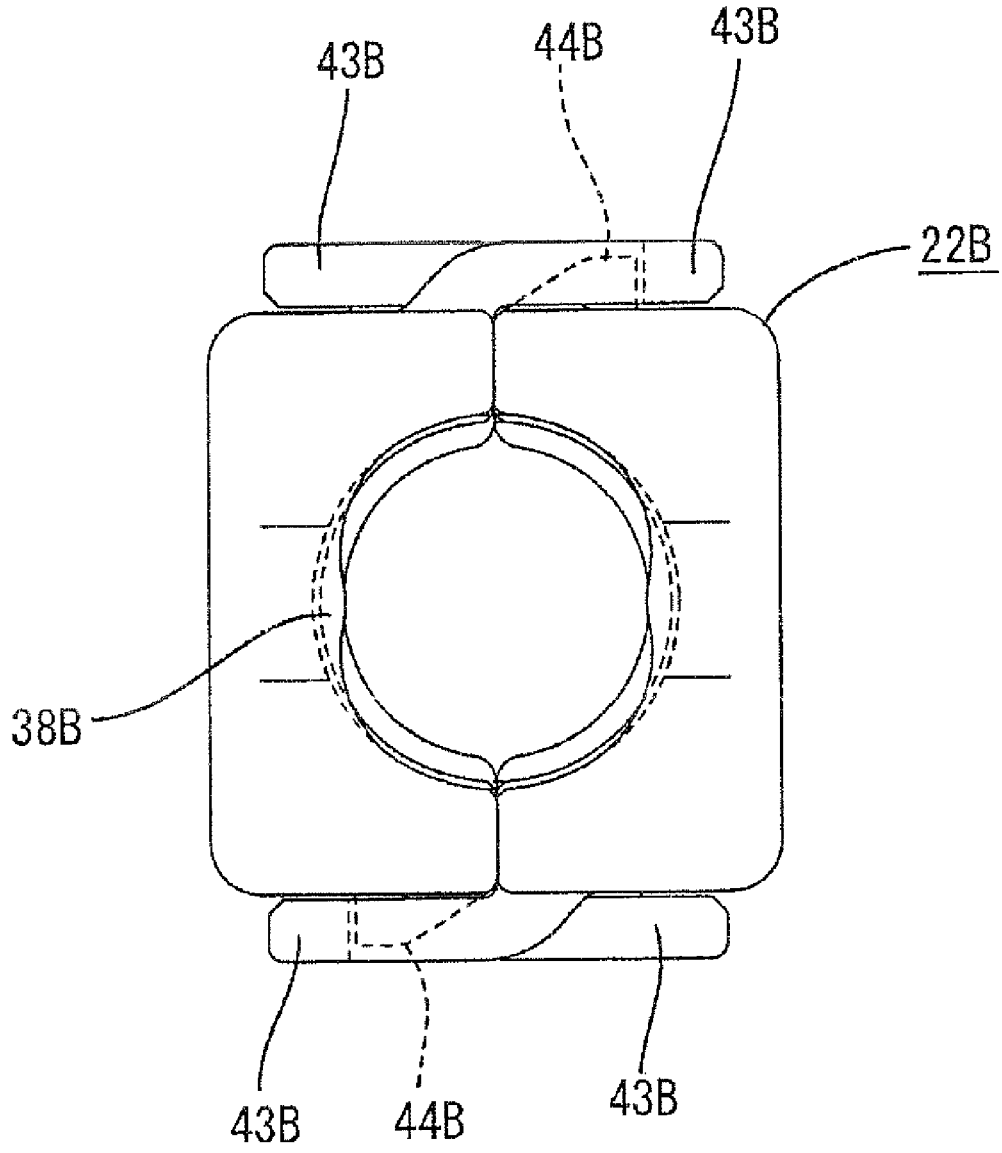
FIG. 28 is a front view showing a movable-side cover.
Figure 29:
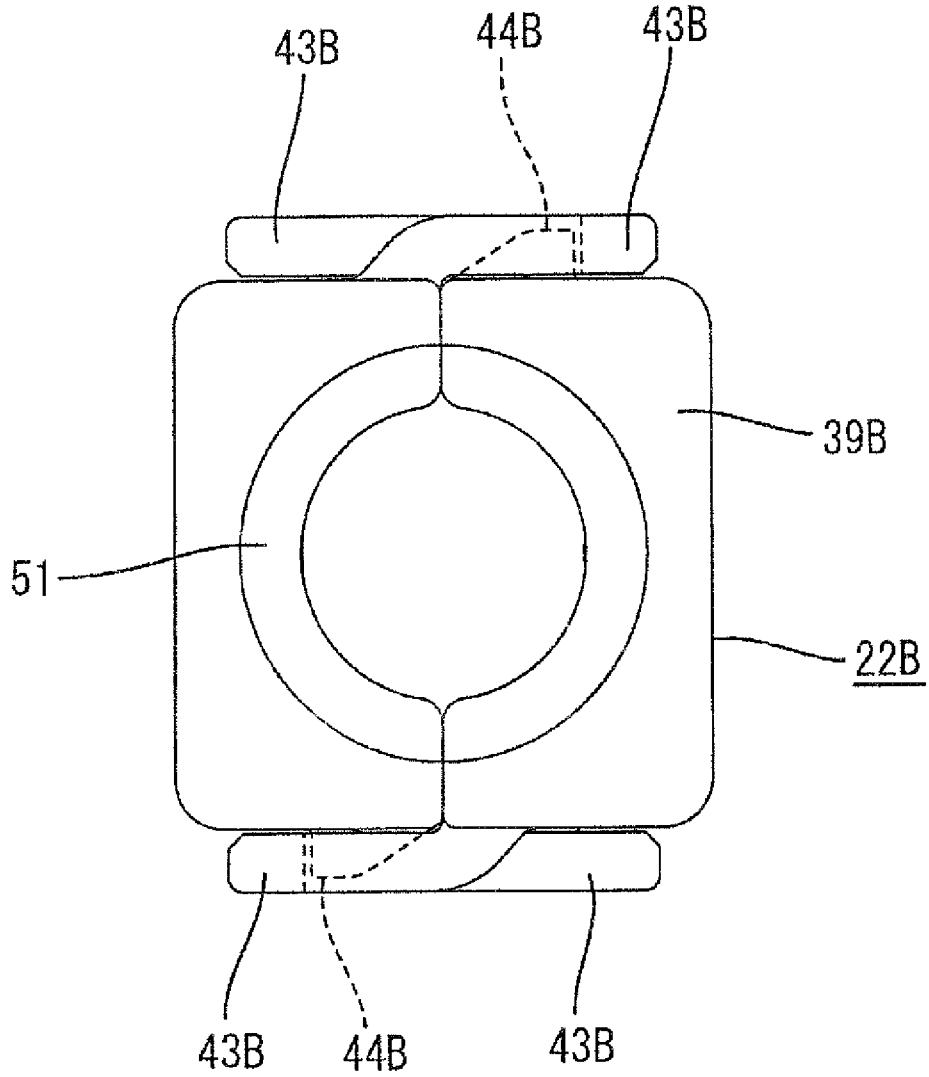
FIG. 29 is a rear view showing the movable-side cover.

The base 46 of the rotation-holding part 38 strikes against the stop 37 of the rear wall 27 when the rotation-holding part 38 rotates to the maximum relative to the spherical receiving part 24 to prevent further rotation of the rotation-holding part 38 (see FIGS. 12, 13). The side of the base 46 opposite to the side that interferes with the stop 37 is disposed in the vicinity of the rear end of the spherical receiving part 24. Thus no gap open to the outside is formed between the spherical receiving part 24 and the side of the base 46 opposite to the side that interferes with the stop 37. The maximum rotational angle of the rotation-holding part 38 in each direction is set to about 45 degrees with respect to the rotational axis.

There is a slight space between the cantilevers 47 and the rear wall 27 of the fixed cover body 23. Thus the rotation of the rotation-holding part 38 in the direction orthogonal to both the axis of the housing 10 and the above-described rotational axis is prevented. The free front end 47*a* of each cantilever 47 protrudes in more than the rear end thereof. Further the inner peripheral surface 48 of the rotation-holding part 38 is spherical and contacts the peripheral surface 36 of the spherical receiving part 24 in the entire region thereof. The front end 47*a* of each cantilever 47 is caught by the front of the spherical receiving part 24 having a smaller diameter than the central portion thereof in its longitudinal direction. Thus, the rotation-holding part 38 is held in a state in which the rotation-holding part 38 is prevented from being removed rearward from the spherical receiving part 24.

Figure 5:
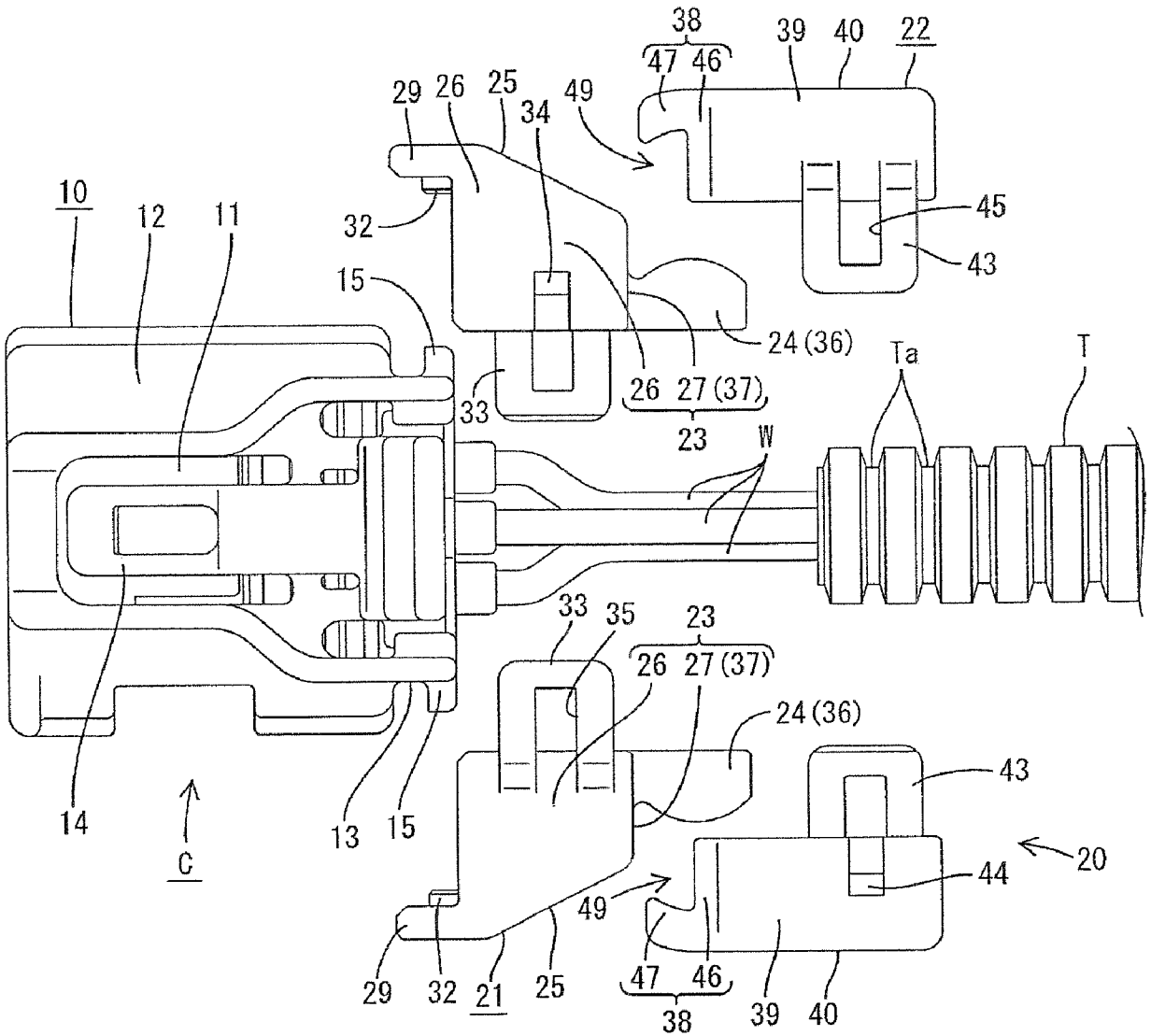
FIG. 5 is a plan view showing a state in which the cover is exploded.
Figure 6:
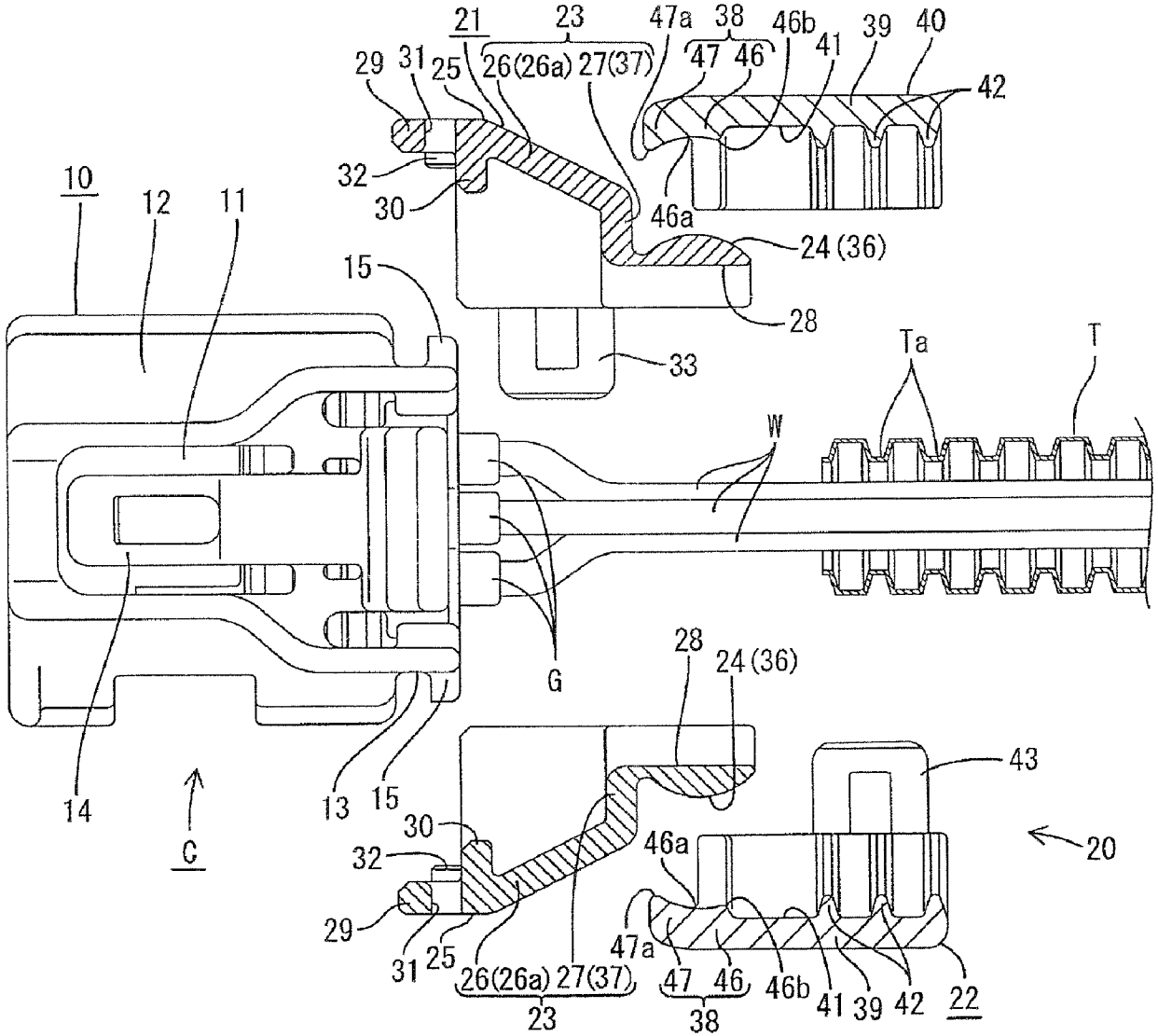
FIG. 6 is a plan sectional view showing the cover exploded.
Figure 7:
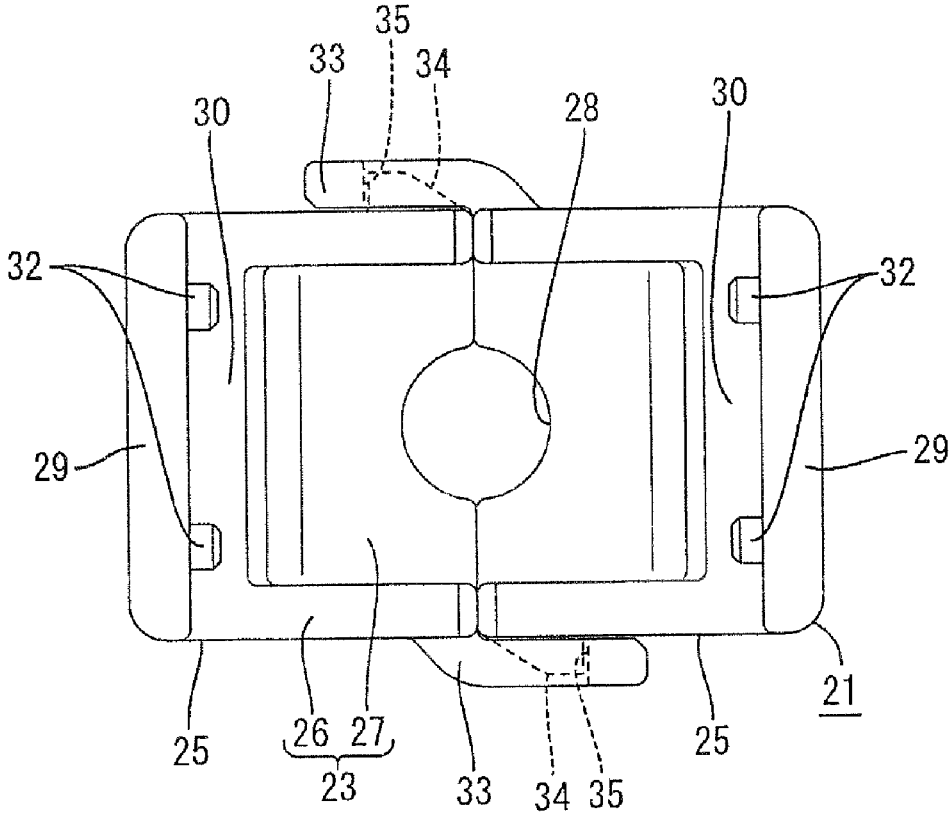
FIG. 7 is a front view showing a fixed-side cover.
Figure 8:
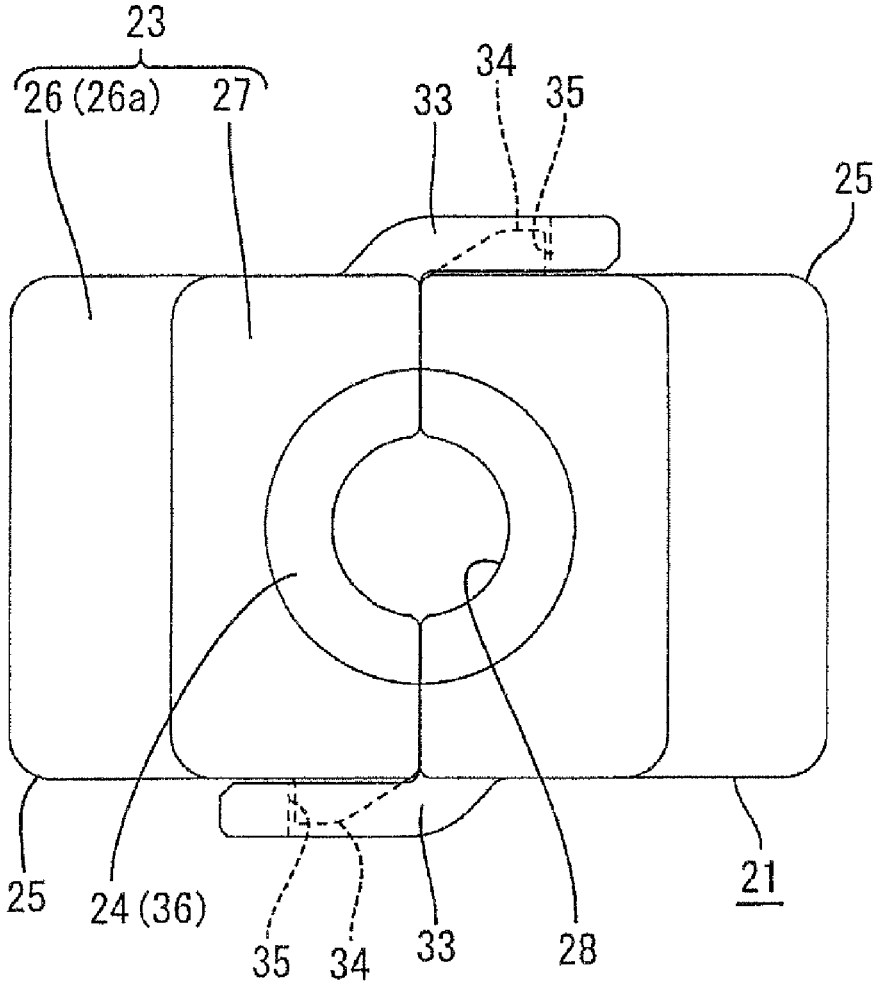
FIG. 8 is a rear view showing the fixed-side cover.

The above-described connector C is assembled initially by inserting the terminal fittings connected with the wires W into the cavities from the rear of the housing 10. The fixed cover 21 then is mounted on the cover-mounting part 13 of the housing 10 when all of the terminal fittings are accommodated in the housing 10, as shown in FIGS. 5 and 6. More particularly, two fixed cover halves 25 are mounted on the sides of the cover-mounting part 13 at both sides so that the convexities 32 fit in the corresponding concave portions 16. As a result, the fixed cover halves 25 are placed vertically in position, and the cover-locks 15 fit in the respective locking holes 31 of the locking piece 29. Thus, the fixed-side cover 21 is held securely on the housing 10. By mounting the fixed cover 21 on the cover-mounting part 13 in this manner, it is unnecessary to deform the locking piece 29 in the mounting step. The holding portion 34 of one fixed cover half 25 advances into the holding groove 35 of the holding piece 33 of the other fixed cover half 25 and is locked to the edge of the holding groove 35. Thus, both fixed cover halves 25 are held together.

The movable cover 22 then is mounted on both the fixed cover 21 and the corrugate tube T. More particularly, the movable cover halves 40 are mounted on the fixed cover 21 at both sides of the spherical receiving part 24, as shown in FIGS. 1 through 4. Thus, both cantilevers 47 of the rotation-holding part 38 are applied to the outer side of the spherical receiving part 24, and the front ends 47*a* of the cantilevers 47 are caught by the front end of the spherical receiving part 24. As a result, the movable cover 22 is held by the fixed cover 21 in a state in which the movable cover 22 is rotatable about the axis of the housing 10 and about a rotational axis orthogonal to the axis of the housing 10. The corrugate tube-holding portion 42 fits in the concavity Ta on outer the peripheral surface of the corrugate tube T when the movable cover 22 is mounted on the fixed cover 21 and the corrugate tube T to hold the corrugate tube T securely on the movable cover 22. The holding portion 44 of one movable cover half 40 advances into the holding groove 45 of the holding piece 43 of the other movable cover half 40 and is locked to the groove edge of the holding groove 45. Thus, both movable cover halves 40 are held in the assembled state.

The above-described assembling procedure can be altered. For example, the movable cover 22 can be mounted on the fixed cover 21 after the terminal fittings are inserted into the cavities. The fixed cover 21, on which the movable cover 22 has been mounted, then is mounted on the housing 10 from the rear. In this case, the locking piece 29 is deformed elastically during mounting the fixed cover 21 on the housing 10.

The mating connector is fit on the assembled connector C to complete the wire harness. The pull-out direction of the wires W may have to be altered in accordance with the mounting place of the connector C in a car and the mounting posture of the connector C. The pull-out direction of the wires W can be altered easily by rotating the movable cover 22 relative to the fixed cover 21. More specifically, to pull the wires W vertically out of the housing 10, the movable cover 22 is rotated relative to the fixed cover 21 about the axis of the housing 10 to align both cut-outs 49 vertically and in the desired pull-out direction of the wires W. Thus, the cantilevers 47 are aligned laterally, as shown in FIGS. 1 through 4. The movable cover 22 then is rotated relative to the fixed cover 21 about the rotational axis extending orthogonal to the axis of the housing 10. The movable cover 22 can be rotated up (see FIG. 4) with respect to the rotational axis, as shown in FIG. 12, and the wires W can be pulled out obliquely up. On the other hand, the movable cover 22 can be rotated down (see FIG. 4) with respect to the rotational axis, as shown in FIG. 13, and the wires W can be pulled out obliquely down.

To pull the wires W laterally to the housing 10, the movable cover 22 is rotated relative to the fixed cover 21 about the axis of the housing 10 to align both cut-outs 49 laterally and in the pull-out direction of the wires W and to align both cantilevers 47 vertically, as shown in FIGS. 14 through 17. In this state, the movable cover 22 is rotated relative to the fixed cover 21 about the rotational axis that extends vertically and orthogonally to the axis of the housing 10. To pull the wires W vertically to the housing 10, the movable cover 22 is rotated relative to the fixed cover 21 about the axis of the housing 10 to align both cut-outs 49 vertically and in the pull-out direction of the wires W and to align both cantilevers 47 laterally. The wires W can be pulled out obliquely up and rearwardly by rotating the movable cover 22 up from the FIG. 16 position to the FIG. 18 position. On the other hand, the wires W can be pulled out obliquely down and rearwardly by rotating the movable cover 22 down from the FIG. 16 position to the FIG. 19 position.

As described above, it is possible to alter the pull-out direction of the electric wires W three-dimensionally by appropriately rotating the movable cover 22 relative to the fixed cover 21. Thus, it is possible to alter the rotational angle about the axis of the housing 10 and about axes orthogonal to the axis of the housing 10.

When the movable cover 22 is rotated to the maximum relative to the fixed cover 21 about the axis of the housing 10 and about the rotational axis orthogonal to the axis of the housing 10, the base 46 of the movable cover 22 strikes against the stop 37 of the fixed cover 21, as shown in FIGS. 12, 13, 18, and 19. Thus, further rotation of the movable cover 22 is prevented. In the state where the further rotation is prevented, the side of the base 46 opposite to its portion (front side in the rotational direction of the rotation-holding part 38) that interferes with the stop 37 always is disposed directly rearward from the rear end of the spherical receiving part 24. Thus the wires W inside the cover 20 are not exposed to the outside and are protected even when the movable cover 22 is rotated to the maximum.

As described above, the fixed cover 21 is fixed to the housing 10 and has the spherical receiving part 24 with the spherical peripheral surface 36. The movable cover 22 has the rotation-holding part 38 fit on the spherical receiving part 24 from the outer side thereof. The rotation-holding part 38 is rotatable relative to the spherical receiving part 24 about the axis of the housing 10. The rotation-holding part 22 has the cut-out 49 that permits the rotation-holding part 38 to rotate relative to the spherical receiving part 24 about rotational axes orthogonal to the axis of the housing 10. This construction allows the movable cover 22 to rotate freely relative to the fixed cover 21 about the axis of the housing 10 and about rotational axes orthogonal to the axis of the housing 10 for freely altering the pull-out direction of the wires W three-dimensionally. As described above, it is possible to diversify the pull-out direction of the wires W without increasing the kinds of the cover 20. Accordingly, the number of kinds of molding dies necessary for manufacturing connectors is decreased and the inventory control of parts is simplified, as compared with the case where a cover is produced specifically in dependence on pull-out directions of the wires W. As a result, it is possible to manufacture the connector at a low cost. It is also possible to secure a sufficient degree of freedom in the pull-out direction of the wires W without altering the posture of the housing 10.

The rotation-holding part 38 has the cut-outs 49 and the cantilevers 47 separated from one another by the cut-outs 49. The movable cover 22 is constructed of two movable cover halves 40 divided along the axis of the housing 10. Each movable cover half 40 has one of the cantilevers 47. Thus, the rotation-holding part 38 can be fit easily on the outer side of the spherical receiving part 24 by mounting both movable cover halves of the movable cover 22 on each other while the cantilevered portions 47 are being applied to the outer side of the spherical receiving part 24. Hence an excellent assembling operation can be performed.

The fixed cover 21 is mounted fixedly on the housing 10, and the movable cover 22 mounted on the end of the fixed cover 21 opposite to the end of the fixed cover 21 that is mounted on the housing 10. The spherical receiving part 24 is on the fixed cover 21 and the rotation-holding part 38 is on the movable cover 22. This construction allows the terminal fittings to be accommodated in the housing 10 before mounting the fixed cover 21 on the housing and hence an operation of accommodating the terminal fittings is performed easily.

The rotation-holding part 38 has the cut-outs 49 disposed symmetrically at two positions spaced at an angular interval of 180 degrees. This construction allows the movable cover 22 to rotate easily in both directions with respect to the rotational axis orthogonal to the axis of the housing 10.

The fixed cover 21 has a stop for preventing the movable cover 22 from rotating about an axis orthogonal to an axis of the housing 10 a sufficient amount to generate a gap between the rotation-holding part 38 and the spherical receiving part 24. This construction prevents the wires W from being exposed to the outside.

Each of the fixed cover 21 and the movable cover 22 is divided along the axis of the housing 10. The fixed cover 21 is composed of two identical fixed cover halves 25 and the movable cover 22 is composed of two identical movable-side cover halves 40. If the fixed and movable covers 21 and 22 were not constructed of the pairs of cover halves 25 and 40 respectively, it would necessary to insert the wires W into the fixed and movable covers 21 and 22 in advance. In this respect, this construction improves the operability in mounting the cover 20 on the housing 10. Further this construction decreases the manufacturing cost and facilitates the inventory control of parts.

The corrugate-holding portion of the movable cover 22 surrounds the wires W pulled out rearward from the movable cover 22 and holds an end of a flexible corrugate tube T. The cover 20 and the corrugate tube T enable the housing to be waterproofed easily.

The second embodiment of the invention is described below with reference to FIGS. 20 through 24. In the first embodiment, the fixed cover 21 is composed of two fixed cover halves 25. In the second embodiment, a fixed cover 21A is composed of one part. The description of the construction and operation of the second embodiment similar to those of the first embodiment are omitted herein.

As shown in FIGS. 20 through 24, the fixed cover 21A does not have a split end portion and is approximately cylindrical. The fixed-side cover 21A is composed of a fixed cover body 23A and a spherical receiving part 24A longitudinally coupled to the fixed cover body part 23A. The fixed cover body 23A has a peripheral wall 26A with side walls 26*a*A and contacts 30A that project in at the front end of both side walls 26*a*A. A concavity 50 is formed on an outer surface of both side walls 26*a*A in correspondence to the projected amount of the contact 30A. Thus, the thickness of both side walls 26*a*A is kept constant. The holding piece 33 and the holding portion 34 of the first embodiment are not needed in the second embodiment and are eliminated.

The fixed cover 21A can be pressed forward on the housing while placing both locking pieces 29A in position for the cover-mounting part 13 of the housing 10. As a result, the locking pieces 29 ride over the cover-locking portion 15 and elastically deform. The locking pieces 29 ride across the cover-locking portion 15 and elastically return to their original state when the fixed-side cover 21A has reached a predetermined normal position. At this time, the cover-locking portion 15 penetrates into a locking hole 31A and is locked to the periphery thereof. Thus, the fixed cover 21A is held on the housing 10. In mounting the fixed cover 21A on the housing 10, it is possible to utilize the concavity 50 of both side walls 26*a*A as an operating portion.

As described above, in the second embodiment, the fixed-side cover 21*a*A is constructed of one component part. Therefore, the second embodiment facilitates inventory control of component parts as compared to the fixed cover 21 of the first embodiment, which is constructed of the two components.

The third embodiment of the invention is described below with reference to FIGS. 25 through 29. In the first embodiment, the corrugate tube T is mounted on the movable cover 22, but in the third embodiment, the corrugate tube T is not mounted on the movable cover 22. The description of the construction and operation of the third embodiment similar to those of the first embodiment are omitted herein.

As shown in FIGS. 25 through 29, a movable cover body 39B of a movable cover 22B is approximately cylindrical and longer than the movable cover body 39 of the first embodiment. Two longitudinally spaced holding pieces 43B and two longitudinally spaced holding portions 44B are formed on the movable cover body 39B with the holding pieces 43B. The movable cover 22B is constructed by mounting two identical movable cover halves 40B on each other. An annular inward projection 51 is formed at a rear end of an inner peripheral surface of the movable cover body 39B. The corrugate tube-holding portion 42 of the first embodiment is not required in the third embodiment and is not provided.

The corrugate tube T is not mounted on the movable cover 22 of the third embodiment. However, the movable cover body 39B is longer than the movable cover body 39 of the first embodiment. Therefore, it is possible to determine the pull-out direction of the wires W bent by rotating a rotation-holding part 38B relative to the spherical receiving part 24 in the distance of the longitudinal dimension of the movable cover body 39B.

The invention is not limited to the embodiments described and illustrated above. For example, the following embodiments are included in the technical scope of the present invention. Further, various modifications of the embodiments can be made without departing from the spirit and scope of the present invention.

In the above-described embodiments, two cut-outs and two cantilevers of the rotation-holding part are disposed at the interval of 180 degrees. However, the number of the cut-outs and the cantilevers and the positions thereof may be altered. For example, three cut-outs and three cantilevers may be formed at intervals of 120 degrees, or four cut-outs and four cantilevers may be formed at intervals of 90 degrees. The invention also includes the rotation-holding part having one cut-out or cut-outs and the cantilevers disposed at irregular intervals.

In the above-described embodiments, the peripheral surface of the receiving part is spherical. However, the peripheral surface of the receiving part does not have to be perfectly spherical, and may deviate to some extent. The peripheral surface of the receiving part does not have to be entirely spherical and may include a flat surface, an inclined surface or other non-spherical surface.

In the above-described embodiments, the inner peripheral surface of the spherical receiving part is formed as the circumferential surface. But the inner peripheral surface of the spherical receiving part may have other configurations. For example, the invention includes a construction in which the inner peripheral surface of the spherical receiving part may be spherical along the spherical peripheral surface thereof and the thickness of the spherical receiving part is set almost constantly.

In the above-described embodiments, the fixed cover is composed of the fixed cover halves. However, the invention includes a fixed cover composed by connecting split ends of both fixed cover halves with a hinge. The movable cover may also be composed by connecting the movable cover halves with a hinge.

In the above-described embodiments, both fixed cover halves of the fixed cover and the movable cover halves of the movable cover have the same configuration respectively. However, the fixed cover halves and the movable cover halves do not necessarily have to have the same configuration respectively.

In the above-described embodiments, the spherical receiving part is on the fixed cover, and the rotation-holding part is on the movable cover. However, the invention includes the construction in which the spherical receiving part is on the movable cover and the rotation-holding part is on the fixed cover.

In the above-described embodiments, the cover is composed of the fixed cover and the movable cover. However, the cover could have only the movable cover. In this case, the rotation-holding on the cover could be mounted on the spherical receiving part on the housing. Alternatively, the housing could have the rotation-holding part and the cover could have the spherical receiving part.

In the above-described embodiments, a part of the rear wall of the fixed cover body of the fixed cover is formed as the stop. However, the mode of the stop can be changed and the stop can be omitted.

In the above-described embodiments, the number of wires is alterable as desired. However, it is preferable to dispose the wires symmetrically.

The invention is applicable to both male and female connectors and to connectors that are not waterproof.

What is claimed is:

1. A connector having a housing for accommodating terminal fittings connected with wires; and a cover mounted on the housing for surrounding the wires pulled out of the housing, comprising:

a receiving part provided on one of the housing and the cover and including a substantially spherically generated peripheral surface; and a rotation-holding part on the other of the housing and the cover, the rotation-holding part having a plurality of cantilevers separated from one another by a corresponding plurality of cut-outs, the cantilevers being fit on said receiving part from an outer side thereof so that said rotation-holding part is rotatable relative to the receiving part about an axis of said housing and is pivotal about axes orthogonal to the axis of the housing at least in directions that include the cut-outs.

2. The connector of claim 1, wherein the housing is provided with the receiving part, and the cover is provided with the rotation-holding part.

3. The connector of claim 1, wherein the cover is constructed of two cover halves divided along a plane that includes the axis of the housing; and one of the cantilevers is provided on each of the cover halves.

4. A connector comprises:

a housing for accommodating terminal fittings connected with wires;

a fixed cover having opposite front and rear ends and a longitudinal axis extending between the ends, the front end of the fixed cover being fixedly mounted on the housing, and a receiving g part formed on the rear end of the fixed cover, the receiving part having a substantially spherically generated outer peripheral surface;

a movable cover having two opposed cantilevers separated from one another by two opposed cut-outs, the cantilevers being mounted on the spherically generated peripheral surface of the receiving part of the fixed cover so that the movable cover is rotatably on the spherically generated peripheral surface of the receiving part about the longitudinal axis and so that the movable cover is pivotal relative to the fixed cover about axes substantially orthogonal to the longitudinal axis.

5. The connector of claim 4, wherein the fixed cover has a corrugate-holding portion surrounding the wires pulled out from the movable cover, the corrugate-holding portion being configured for holding an end of a flexible corrugate tube.

6. The connector of claim 1, wherein the rotation-holding part has a symmetrical configuration with the cut-outs disposed at two positions spaced at an angular interval of 180 degrees.

7. The connector of claim 1, wherein one of the housing and the cover is provided with a stop for preventing pivoting of the cover before a gap is generated between the rotation-holding part and the receiving part when the cover is pivoted relative to the housing about at least one of the axes orthogonal to the axis of the housing.

8. The connector of claim 1, wherein the cover is divided along a plane that includes the axis of the housing and is defined by two substantially identical cover halves.

* * * * *